US006564781B2

(12) United States Patent
Matsumoto et al.

(10) Patent No.: US 6,564,781 B2
(45) Date of Patent: May 20, 2003

(54) ABNORMALITY DETECTING APPARATUS FOR FUEL EVAPORATIVE EMISSION CONTROL SYSTEM OF INTERNAL COMBUSTION ENGINE

(75) Inventors: Norio Matsumoto, Tokyo (JP); Shinya Fujimoto, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/994,038

(22) Filed: Nov. 28, 2001

(65) Prior Publication Data

US 2002/0179066 A1 Dec. 5, 2002

(30) Foreign Application Priority Data

May 31, 2001 (JP) ..... 2001-164519

(51) Int. Cl.[7] ..... F02M 37/04
(52) U.S. Cl. ..... 123/520; 123/519
(58) Field of Search ..... 123/516, 518, 123/519, 520, 198 D; 73/117.1, 117.3

(56) References Cited

U.S. PATENT DOCUMENTS 5,596,972 A * 1/1997 Sultan et al. ..... 123/520
6,450,159 B2 * 9/2002 Ohkuma ..... 123/520

FOREIGN PATENT DOCUMENTS

JP 7-42632 2/1995 ..... F02M/25/08
JP 9-296753 11/1997 ..... F02M/25/08
JP 11-210569 8/1999 ..... F02M/25/08

* cited by examiner

*Primary Examiner*—Thomas N. Moulis
(74) *Attorney, Agent, or Firm*—Sughrue Mion, PLLC

(57) ABSTRACT

An abnormality detecting apparatus for a fuel evaporative emission control system which ensures enhanced reliability includes a canister (9) disposed in a purge passage, a purge control valve (10), a control means (20) for controlling opening/closing of the purge control valve (10) in dependence on engine operation states, a means (18) for detecting an intake pressure (Pb), a means for detecting at least one of an atmospheric pressure (PA), an outside air temperature (TG), an intake air temperature (TA) and a fuel temperature (TT), a means (19) for detecting a fuel tank pressure (Pt), a means (20) for determining validity of abnormality decision enabling conditions in the case where concentration of fuel gas is lower than a reference value for comparison, a means (20) for regulating a purge rate in dependence on an intake pressure (Pb) when the abnormality decision enabling conditions are valid, a means (20) for detecting occurrence of abnormality in the fuel evaporative emission control system on the basis of the fuel tank pressure (Pt) when the abnormality decision enabling conditions are valid, and a condition validation limiting means (20) for correcting the comparison reference value in dependence on at least one of the atmospheric pressure (PA), the fuel temperature (TT), the outside air temperature (TG) and the intake air temperature (TA).

7 Claims, 14 Drawing Sheets

| | | | | |
|---|---|---|---|---|
| ATMOSPHERIC PRESSURE PA[KPa] | 70 | · · · | 95 | 101 |
| COMPARISON REFERENCE VALUE PGN (PA) [%] | 30 | · · · | 50 | 60 |

FIG. 10

| FUEL TEMPERATURE TT[°C] | -30 | · · · | 100 | 110 |
|---|---|---|---|---|
| COMPARISON REFERENCE VALUE PGN (TT) [%] | 70 | · · · | 35 | 30 |

FIG. 11

| INTAKE AIR TEMPERATUR TA[°C] | -30 | · · · | 100 | 110 |
|---|---|---|---|---|
| COMPARISON REFERENCE VALUE PGN (TA) [%] | 70 | · · · | 20 | 20 |

FIG. 12

| OUTSIDE AIR TEMPERATURE TG[°C] | -30 | · · · | 100 | 110 |
|---|---|---|---|---|
| COMPARISON REFERENCE VALUE PGN (TG) [%] | 70 | · · · | 20 | 20 |

FIG. 13A

| | | | | |
|---|---|---|---|---|
| ATMOSPHERIC PRESSURE PA[KPa] | 70 | · · · | 95 | 101 |
| COMPARISON REFERENCE VALUE PGN (PA) [%] | 30 | · · · | 50 | 60 |

FIG. 13B

| | | | | |
|---|---|---|---|---|
| FUEL TEMPERATURE TT[℃] | -30 | · · · | 100 | 110 |
| CORRECTING COEFFICIENT KPGN (TT) [%] | 1.0 | · · · | 0.4 | 0.3 |

FIG. 14

FOR LARGE-HOLE-LEAK ABNORMALITY

| | | | | | |
|---|---|---|---|---|---|
| ATMOSPHERIC PRESSURE PA [KPa] | 70 | 75 | · · · | 95 | 101 |
| COMPARISON REFERENCE VALUE PGNL (PA) [%] | 90 | 90 | · · · | 100 | 100 |

FIG. 15

FOR SMALL-HOLE-LEAK ABNORMALITY

| | | | | | |
|---|---|---|---|---|---|
| ATMOSPHERIC PRESSURE PA [KPa] | 70 | 75 | · · · | 95 | 101 |
| COMPARISON REFERENCE VALUE PGNS (PA) [%] | 30 | 35 | · · · | 50 | 60 |

FIG. 18

FOR LARGE-HOLE-LEAK ABNORMALITY

| INTAKE AIR TEMPERATURE TA[°C] | -30 | -20 | · · | 100 | 110 |
|---|---|---|---|---|---|
| HERMETICAL CLOSURE TIME PERIOD TPL (TA) [sec] | 40 | 40 | · · | 40 | 40 |

FIG. 19

FOR SMALL-HOLE-LEAK ABNORMALITY

| INTAKE AIR TEMPERATURE TA[°C] | -30 | -20 | · · | 100 | 110 |
|---|---|---|---|---|---|
| HERMETICAL CLOSURE TIME PERIOD TPS (TA) [sec] | 35 | 35 | · · | 25 | 22 |

PRIOR ART

ABNORMALITY DETECTING APPARATUS FOR FUEL EVAPORATIVE EMISSION CONTROL SYSTEM OF INTERNAL COMBUSTION ENGINE

BACKGROUND OF THE INVENTION

1. Field of the Invention

The present invention generally relates to a fuel evaporative emission control system for preventing or suppressing evaporative emission of a fuel gas which is generated or produced within a fuel tank of an internal combustion engine for a motor vehicle or the like. More particularly, the present invention is concerned with an abnormality detecting apparatus for detecting occurrence of abnormality such as leakage or leak of the fuel gas in the fuel evaporative emission control system.

2. Description of Related Art

In general, in the internal combustion engine for motor vehicles or the like, it is statutorily imposed to equip the engine with a fuel evaporative emission control system with the aim of suppressing or preventing evaporative emission of the fuel gas produced within a fuel tank to the atmosphere. Incidentally, this system is also known as the fuel evaporative emission suppressing (or preventing) system.

The fuel evaporative emission control system of the type known heretofore is composed of a sensor means for detecting operation states of the internal combustion engine such as rotation speed, load state and others of the engine, a purge passage for communicating the fuel tank provided for supplying the fuel to the engine and an intake pipe thereof with each other and a canister disposed in the purge passage at an intermediate location thereof.

The canister adopted for adsorbing the fuel gas produced within the fuel tank has an atmospheric air port which can be opened to the atmosphere, wherein a purge control valve is disposed at an intermediate location between the canister and the intake pipe of the engine. An adsorbent disposed within the canister adsorbs the fuel gas on the way of flowing through the purge passage through which the fuel tank and the intake pipe are placed in communication.

Further, the fuel evaporative emission control system includes a fuel evaporative emission control means (usually constituted by a microcomputer or microprocessor) for controlling opening/closing operation of the purge control valve in dependence on the operation states of the internal combustion engine in order to sustain the fuel gas adsorbing function of the canister by preventing the adsorbent from becoming saturated.

The fuel evaporative emission control means is so designed or programmed as to control opening/closing of the purge control valve in dependence on the operation states of the internal combustion engine for causing the fuel gas adsorbed by the canister to be discharged into the intake pipe so that the fuel gas is mixed with the mixture of air and fuel to be subsequently fed to the engine. In this manner, the evaporative emission of the fuel can be avoided.

Ordinarily, in the fuel evaporative emission control system such as described above, the purge passage is constituted by a rubber hose which fluidally interconnects the canister and the intake pipe. Accordingly, if the rubber hose should be bent or collapsed, there will arise such unwanted situation that the fuel gas can not satisfactorily be introduced into the intake pipe and hence the amount of the fuel gas retained within the canister will exceed the fuel gas adsorbing capability of the adsorbent accommodated within the canister, which will naturally result in discharging of the fuel gas to the atmosphere through the atmospheric air port of the canister without the fuel gas being recirculated to the intake pipe, giving rise to a problem.

Furthermore, since the rubber hose is placed in contact with alcohol component of the fuel, there undesirably exists the possibility of the rubber hose being damaged due to corrosion. Besides, in the case where the atmospheric air port of the canister should get clogged with dusts, the rubber hose will be detached under the effect of increasing of pressure. In either case, the fuel gas will unwontedly be discharged to the atmosphere, giving rise to a problem.

For coping with the above-mentioned problems by detecting the abnormal situation such as described above, there has already been proposed an abnormality detecting apparatus which is so arranged as to detect or determine occurrence of abnormality in the fuel evaporative emission control system when the pressure prevailing within the fuel tank as detected by an associated pressure sensor exceeds a permissible maximum pressure level and/or when a predetermined pressure difference is not detected before and after changeover of the purge control valve between the opened state and the closed state. For more particulars, reference should be made to, for example, Japanese Patent Application Laid-Open Publication No. 125997/1993 (JP-A-5-125997).

With the conventional abnormality detecting apparatus disclosed in the publication cited above, it is certainly possible to detect positively and accurately the blockage of the atmospheric air port of the canister, impossibility of opening the purge control valve, damage and/or fall-off of the hose serving as the purge passage on the side of the intake pipe. It is however noted that in the abnormality detecting apparatus mentioned above, the purge rate is determined without taking into consideration the intake pressure (i.e., pressure prevailing within the intake pipe) and the remaining fuel quantity at the time point when abnormality decision enabling conditions are validated (i.e., when the conditions for enabling or allowing the decision as to occurrence of abnormality are satisfied, to say in another way). Consequently, a lot of time will be taken for determining the abnormality, being accompanied with the possibility of erroneous detection of abnormality, for the reason that smooth and speedy lowering of the fuel tank pressure upon abnormality detection is hindered by flow resistance encountered within the purge passage and a variable void volume of the fuel tank.

On the other hand, there may also arise such situation that the fuel tank pressure lowers excessively although it depends on the flow resistance within the purge passage and the void volume of the fuel tank, which may result in that the fuel tank is deformed or collapsed under the effect of excessively high negative pressure.

Additionally, it is noted that in the above-mentioned abnormality detecting apparatus for the fuel evaporative emission control system, concentration of the fuel gas which flows into the intake pipe from the canister is not taken into account in establishing the abnormality decision enabling conditions. Consequently, when the concentration of the fuel gas flowing into the intake pipe of the engine is high, there arises the possibility that the engine operation becomes out of order.

Under the circumstances, there has been proposed an abnormality detecting apparatus which includes an abnormality detecting means for detecting abnormality of the fuel evaporative emission control system on the basis of the pressure within the fuel tank (hereinafter also referred to as the fuel tank pressure) and a purge rate regulating means for adjusting or regulating the purge rate in dependence on the pressure prevailing within the intake pipe (hereinafter also referred to as the intake pressure) at the time when the abnormality decision enabling conditions are validated, as is disclosed in, for example, Japanese Patent Application Laid-Open Publication No. 296753/1997 (JP-A-9-296753).

For having better understanding of the concept of the present invention, description will be made in some detail of the abnormality detecting operation carried out by the abnormality detecting apparatus disclosed in the publication cited just above. FIG. 22 of the accompanying drawings shows a flow chart for illustrating the abnormality detecting operation of the abnormality detecting apparatus now concerned.

Referring to FIG. 22, decision is first made in a step S101A as to whether the concentration of the fuel gas (hereinafter also referred to as the fuel gas concentration) as detected by resorting to an appropriate method (see JP-A-9-296753 for more particulars) is higher or lower than a predetermined concentration. When it is decided that the fuel gas concentration is higher than the predetermined concentration, it is then determined in a step S101D that the abnormality decision enabling conditions are to be invalidated (i.e., unsatisfied), whereon the processing routine shown in FIG. 22 is terminated.

By contrast, when the decision in the step S101A results in that the fuel gas concentration is lower than the predetermined concentration, other conditions are checked in a step S101B. If the other conditions are valid, then it is determined in a step S101C that the abnormality decision enabling conditions are to be validated, whereon the processing routine shown in FIG. 22 is terminated.

As is apparent from the above, the concentration of the fuel gas introduced into the intake pipe from the canister is detected. Unless the fuel gas concentration is lower than the comparison reference value, it is determined that the abnormality detection enabling conditions for the fuel evaporative emission control system is invalid, i.e., not satisfied. Only when the abnormality detection enabling conditions are valid, the fuel tank pressure can be lowered to a desired or target pressure level with high accuracy, whereby the abnormality decision for the fuel evaporative emission control system can be performed speedily and accurately.

However, because the abnormality detection enabling conditions are determined to be invalidated on the basis of only the result of comparison between the fuel gas concentration and the reference value therefor, there may arise a problem that the validity of the abnormality detection enabling conditions can not always be determined with high reliability.

By way of example, the evaporative emission of the fuel within the fuel tank is easy to take place when the engine is operated in a highland region (where the atmospheric pressure is low) while it is difficult to occur in a lowland region (where the atmospheric pressure is high) even for a same fuel gas concentration level. However, since such influence of the atmospheric pressure is not taken into consideration, the abnormality detection performance in the highland region (where the atmospheric pressure is low) tends to degrade.

By contrast, in the lowland region (where the atmospheric pressure is high), the abnormal state may erroneously be detected.

Similarly, the evaporative emission of the fuel from the fuel tank will vary under the influence of the fuel temperature, the outside air temperature, the intake air temperature and the like even for a same fuel gas concentration level. However, such influence of the temperatures is not considered either, which will incur degradation of the abnormality detection performance as well as erroneous abnormality detection.

Additionally, it is noted that susceptibility of the fuel to the evaporative emission from the fuel tank varies in dependence on the degree of leak abnormality of the fuel evaporative emission control system such as fall-off of a cap of the fuel tank, detachment of the pipe serving as the purge passage or the like. However, variation of the fuel gas concentration in dependence on the degree of leak abnormality is not taken into account in the case of the abnormality detecting apparatus disclosed in the second mentioned publication. Consequently, when remarkable leak abnormality takes place due to fall-off of the cap of the fuel tank, the fuel evaporative emission becomes easier to take place, increasing the fuel gas concentration, which makes it difficult to inhibit or disable the abnormality detection (invalidate the abnormality detection enabling conditions) on the basis of the fuel gas concentration.

Moreover, since the susceptibility of fuel to the evaporative emission from the fuel tank changes in dependence on the atmospheric pressure, the outside air temperature and the like factors, the fuel tank pressure increases only slowly in the low temperature state while increasing rapidly in the high temperature state even for a same leak abnormality during a hermetical closure time period set for the purpose of detection of occurrence of abnormality in the fuel evaporative emission control system. However, in the abnormality detecting apparatus disclosed in the second mentioned publication, the rate of change of the fuel tank pressure is not considered either, and the hermetical closure time period is set to be constant, which may unwantedly lead to degradation of the abnormality detection performance.

As can now be appreciated from the foregoing, in the conventional abnormality detecting apparatuses for the fuel evaporative emission control system known heretofore such as the one disclosed in, for example, Japanese Patent Application Laid-Open Publication No. 296753/1997 (JP-A-9296753) which is considered as one of the most improved apparatus, the comparison reference value for determining the validity of the abnormality detection enabling conditions is set to be constant. As a consequence, the abnormality detection performance undergoes degradation under the influence of variation of the various environmental conditions, which may ultimately lead to impossibility of detecting the abnormality with high accuracy and reliability, thus giving rise to a problem.

Besides, since the hermetical closure time period for the abnormality detection is set constant, there may arise the problem that degradation of the abnormality detection performance is incurred.

SUMMARY OF THE INVENTION

In the light of the state of the art described above, it is an object of the present invention to provide an abnormality detecting apparatus for a fuel evaporative emission control system which can enjoy enhanced reliability by virtue of such arrangement that the comparison reference value for determining validity of the abnormality detection enabling conditions is set variable in dependence on various environmental conditions and the like.

Another object of the present invention is to provide an abnormality detecting apparatus for a fuel evaporative emission control system which can enjoy high reliability owing to such arrangement that the hermetical closure time period for the abnormality detection is set variable in dependence on the various environment conditions and the like.

In view of the above and other objects which will become apparent as the description proceeds, there is provided according to a general aspect of the present invention an abnormality detecting apparatus for detecting occurrence of abnormality in a fuel evaporative emission control system for an internal combustion engine, which apparatus includes sensor means for detecting engine operation states including rotation speed and load state of the internal combustion engine, a purge passage for communicating a fuel tank supplying a fuel to the internal combustion engine and an intake pipe thereof with each other, a canister disposed at an intermediate location of the purge passage for adsorbing a fuel gas generated within the fuel tank, an atmospheric air port provided for the canister and opened to the atmosphere, a purge control valve disposed intermediately between the canister and the intake pipe, and a fuel evaporative emission control means for suppressing evaporative emission of the fuel by controlling opening/closing of the purge control valve in dependence on operation states of the internal combustion engine and introducing the fuel gas adsorbed by the canister into the intake pipe as occasion requires.

The sensor means includes an intake pressure detecting means for detecting an intake pressure information representing a load state of the internal combustion engine, at least one of an atmospheric pressure detecting means for detecting an atmospheric pressure, an outside air temperature detecting means for detecting an outside air temperature, an intake-air temperature detecting means for detecting an intake air temperature of the internal combustion engine, and a fuel temperature detecting means for detecting a fuel temperature within the fuel tank, a fuel tank pressure detecting means for detecting a pressure within the fuel tank as a fuel tank pressure, a fuel-gas concentration detecting means for detecting concentration of the fuel gas introduced into the intake pipe from the canister, an air port blocking means for closing the atmospheric air port, a hermetically closing means for closing both the purge control valve and the atmospheric air port to thereby place the fuel evaporative emission control system as a whole in a hermetically closed state, an abnormality decision enabling condition detecting means for determining validity of abnormality decision enabling conditions for allowing decision to be made as to occurrence of abnormality in the fuel evaporative emission control system on the basis of the operation state of the internal combustion engine in the case where the fuel gas concentration is lower than a reference value for comparison, a purge rate regulating means for regulating a purge rate by controlling an opening degree of the purge control valve in dependence on the intake pressure when the abnormality decision enabling conditions are valid, and an abnormality detecting means for detecting abnormality of the fuel evaporative emission control system on the basis of the fuel tank pressure which has dependency on the purge rate when the abnormality decision enabling conditions are valid.

The abnormality decision enabling condition detecting means includes a condition validation limiting means for limiting validation of the abnormality detection enabling conditions by correcting the reference value for comparison in dependence on at least one of the atmospheric pressure, the fuel temperature, the outside air temperature and the intake air temperature.

In a mode for carrying out the invention, the condition validation limiting means may preferably be so designed as to correct the comparison reference value such that the comparison reference value is decreased when at least one of the atmospheric pressure, the fuel temperature, the outside air temperature and the intake air temperature changes such that the evaporative emission of the fuel is promoted.

In another mode for carrying out the invention, the abnormality decision enabling condition detecting means may preferably be so designed as to set distinctively a first comparison reference value and a second comparison reference value, respectively, for a first abnormal state and a second abnormal state which can be presumed on the basis of the fuel tank pressure and change over the first comparison reference value and the second comparison reference value in dependence on the first abnormal state and the second abnormal state, respectively.

In yet another preferred mode for carrying out the invention, the first abnormal state corresponds to a large-hole-leak abnormality while the second abnormal state corresponds to a small-hole-leak abnormality, wherein the abnormality decision enabling condition detecting means may be so designed as to set the second comparison reference value employed for detecting the second abnormal state to be smaller than the first comparison reference value employed for detecting the first abnormal state.

In still another mode for carrying out the invention, the hermetically closing means may preferably be so designed as to set changeably a hermetical closure time period during which the fuel evaporative emission control system as a whole is placed in a hermetically closed state in dependence on at least one of the atmospheric pressure, the fuel temperature, the outside air temperature and the intake air temperature.

In a further mode for carrying out the invention, the hermetically closing means may preferably be so designed as to set distinctively a first hermetical closure time period and a second hermetical closure time period, respectively, for a first abnormal state and a second abnormal state which can be presumed on the basis of the fuel tank pressure and change over the first hermetical closure time period and the second hermetical closure time period in dependence on the first abnormal state and the second abnormal state, respectively.

In a yet further preferred mode for carrying out the invention, the first abnormal state corresponds to a large-hole-leak abnormality while the second abnormal state corresponds to a small-hole-leak abnormality, wherein the hermetically closing means may be so designed as to set the second hermetical closure time period employed for detecting the second abnormal state to be shorter than the first hermetical closure time period employed for detecting the first abnormal state.

By virtue of the arrangements described above, there can be realized the abnormality detecting apparatus for the fuel evaporative emission control system which can ensure enhanced reliability and accuracy for the decision of occurrence of abnormality event in the system.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which:

FIG. 10 is a view showing a comparison reference value which is set changeably in dependence on fuel temperature according to a second embodiment of the present invention;

FIG. 11 is a view showing a comparison reference value which is set changeably in dependence on intake air temperature according to a third embodiment of the present invention;

FIG. 12 is a view showing a comparison reference values which is set changeably in dependence on outside air temperature according to the third embodiment of the invention;

FIGS. 13A and 13B are views for illustrating comparison reference values which are set changeably in dependence on plural parameters according to a fourth embodiment of the present invention, wherein FIG. 13A shows the comparison reference value set changeably in dependence on atmospheric pressure while FIG. 13B shows a correcting coefficient set changeably in dependence on fuel temperature;

FIG. 14 is a view showing a comparison reference value set for determining a large-hole-leak abnormality according to a fifth embodiment of the present invention;

FIG. 15 is a view showing a comparison reference value set for determining a small-hole-leak abnormality according to the fifth embodiment of the invention;

FIG. 18 is a view showing a hermetical closure time period set for determination of large-hole-leak abnormality according to a sixth embodiment of the present invention;

FIG. 19 is a view showing a hermetical closure time period set for determination of small-hole-leak abnormality according to the sixth embodiment of the invention;

DESCRIPTION OF THE PREFERRED EMBODIMENTS

Figure 1:
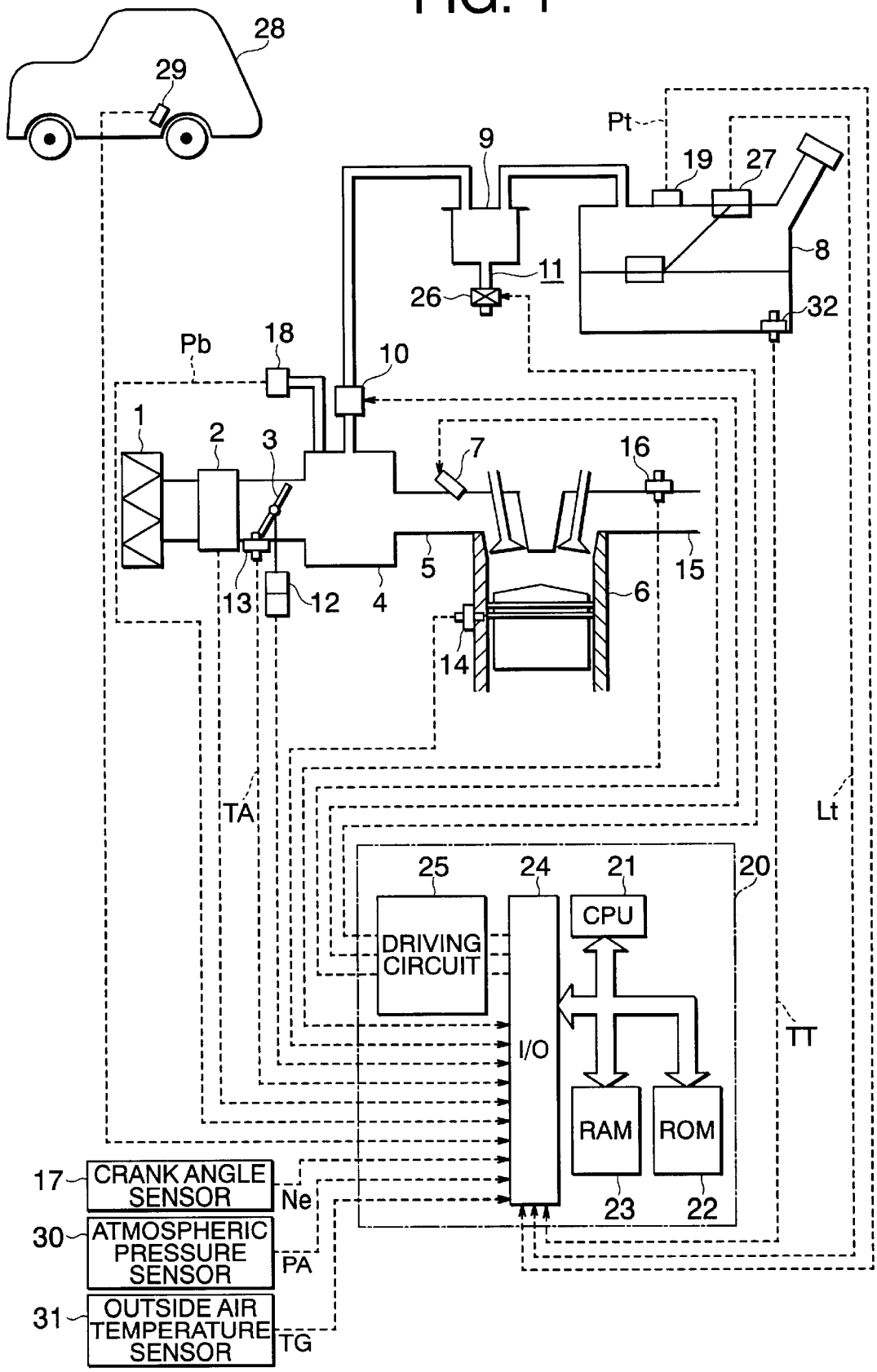
FIG. 1 is a block diagram showing generally and schematically an arrangement of an abnormality detecting apparatus for detecting occurrence of abnormality in a fuel evaporative emission control system of an internal combustion engine according to a first embodiment of the present invention.

The present invention will be described in detail in conjunction with what is presently considered as preferred or typical embodiments thereof by reference to the drawings. In the following description, like reference characters designate like or corresponding parts throughout the several views.

Embodiment 1

FIG. 1 is a block diagram showing generally and schematically an arrangement of an abnormality detecting apparatus for detecting occurrence of abnormality in a fuel evaporative emission control system of an internal combustion engine according to a first embodiment of the present invention.

Referring to FIG. 1, air sucked through an air cleaner 1 is fed to individual cylinders of an engine 6 which constitutes a main body of the internal combustion engine system by way of an intake pipe 5 which is equipped with an air flow sensor 2, a throttle valve 3 and a surge tank 4.

The air flow sensor 2 is designed to measure the rate of intake air flow fed to the engine 6 through the intake pipe 5. The output signal of the air flow sensor 2 indicating the intake air flow rate as measured is supplied to an electronic control unit (hereinafter also referred to as the ECU in abbreviation) 20.

On the other hand, the throttle valve 3 serves to regulate or adjust the intake air flow fed to the engine 6 in dependence on the depression stroke of an accelerator pedal (not shown) manipulated by an operator or driver of a motor vehicle 28.

The intake pipe 5 is further equipped with a fuel injector 7 for injecting an amount of fuel into the intake pipe or manifold 5. To this end, a fuel tank 8 for supplying the fuel to the internal combustion engine (hereinafter also referred to simply as the engine) 6 is provided. The fuel tank 8 is placed in communication with the fuel evaporative emission control system which is provided in association with various-types of sensor means.

The sensor means mentioned above are destined for detecting the operation states of the engine 6 such as, for example, engine speed (engine rotation number) Ne, load state, charging efficiency Ec and the like. As the sensor means, there can be enumerated the air flow sensor 2, a throttle position sensor 12, an intake-air temperature sensor 13, a water temperature sensor 14, an air-fuel ratio sensor ($O_2$-sensor) 16, a crank angle sensor 17, an intake pressure sensor (also referred to as the boost pressure sensor) 18, a fuel tank pressure sensor 19, a fuel level gauge 27, a vehicle speed sensor 29, an atmospheric pressure sensor 30, an outside air temperature sensor 31 and a fuel temperature sensor 32.

The throttle position sensor 12 is mounted on a rotatable shaft of the throttle valve 3 for detecting the opening degree thereof while the intake-air temperature sensor 13 is provided in association with the intake pipe 5 for detecting the temperature TA of the intake air. The water temperature sensor 14 serves to detect the temperature of cooling water for the engine 6. The air-fuel ratio sensor 16 is provided in association with an exhaust pipe 15 of the engine 6 for generating an air-fuel ratio feedback signal.

The crank angle sensor 17 is designed to generate a crank angle signal representative of the rotation speed (rotation number Ne) of the engine 6. The intake pressure sensor 18 is provided in association with the surge tank 4 of the intake pipe 5 for detecting an intake pressure Pb prevailing within the intake pipe 5.

The fuel tank pressure sensor 19 is provided in association with the fuel tank 8 to detect the fuel tank pressure (i.e., internal pressure of the fuel tank) Pt, while the fuel level gauge 27 serves to detect a level Lt of the fuel contained in the fuel tank 8.

The vehicle speed sensor 29 is installed at a location near to an axle of the motor vehicle 28 which is equipped with the engine system now under consideration and serves for detecting the speed of the motor vehicle 28.

The atmospheric pressure sensor 30 is designed to detect the outside air pressure as the atmospheric pressure PA, while the outside air temperature sensor 31 is designed to detect the outside air temperature TG. On the other hand, the fuel temperature sensor 32 is dedicated for detecting the temperature TT of the fuel contained in the fuel tank 8.

The detection signals outputted from the various sensor means mentioned above are inputted to the ECU 20 as the information signals indicative of the operation states of the engine.

The fuel evaporative emission control system is comprised of a canister 9 installed in a purge passage, a purge control valve 10 disposed intermediately between the canister 9 and the intake pipe 5, and a fuel evaporative emission control means for suppressing or preventing evaporative emission of the fuel by controlling opening/closing operation of the purge control valve 10. The fuel evaporative emission control means mentioned above is incorporated in the ECU 20.

The fuel tank 8 and the intake pipe 5 are placed in communication through the purge passage.

The canister 9 accommodates therein activated carbon as the adsorbent and is disposed at an intermediate location of the purge passage for adsorbing the fuel gas generated within the fuel tank 8.

The canister 9 is provided with an atmospheric air port 11 which can be opened to the atmosphere through an air port control valve 26.

The air port control valve 26 constitutes an air port blocking means in cooperation with the ECU 20. In other words, the atmospheric air port 11 is opened or closed by means of the air port control valve 26 under the control of the ECU 20.

The fuel evaporative emission control means incorporated in the ECU 20 is so designed or programmed as to control the opening/closing operation of the purge control valve 10 in dependence on the operation states of the engine 6 for the purpose of suppressing the evaporative emission of the fuel gas adsorbed by the canister 9 by introducing the fuel gas into the intake pipe 5 as occasion requires.

More specifically, the fuel evaporative emission control means is so designed as to open the purge control valve 10 on the basis of a purge valve control quantity (i.e., duty control quantity corresponding to the purge rate) which is determined in dependence on the operation state of the engine 6 for thereby causing the fuel gas adsorbed by the canister 9 to be purged into the intake pipe 5 under the effect of the negative pressure prevailing within the intake pipe 5.

In that case, the air introduced into the canister 9 through the atmospheric air port 11 opened by means of the air port control valve 26 is purged into the intake pipe 5 as the air (purge air) for carrying the fuel gas desorbed from activated carbon when the air is caused to pass through the adsorbent such as activated carbon accommodated in the canister 9.

The ECU 20 is constituted by a microcomputer or microprocessor which includes a CPU (Central Processing Unit) 21, a ROM (Read-Only Memory) 22, a RAM (Random Access Memory) 23 and others for carrying out various controls such as air-fuel ratio control, ignition timing control and others for the engine 6.

An input/output interface 24 incorporated in the ECU 20 is designed to fetch the signals from the various-types of sensor means mentioned hereinbefore as the detection information and output control signals to various types of actuators through a driving circuit 25.

More specifically, the CPU 21 incorporated in the ECU 20 performs arithmetic operation for the air-fuel ratio feedback control in accordance with a control program on the basis of various data tables or maps stored in the ROM 22 to thereby control operation of the fuel injector 7 by way of the driving circuit 25.

Further, the ECU 20 performs the conventional engine controls such as the ignition timing control, the exhaust gas recirculation (EGR) control, the idling rotation speed control and the like for the engine 6 in dependence on the operation states thereof in addition to the control of opening/closing operations of the purge control valve 10 and the air port control valve 26.

Furthermore, the ECU 20 includes a fuel-gas concentration detecting means for detecting the concentration of the fuel gas introduced or purged into the intake pipe from the canister. The fuel-gas concentration detecting means is so designed or programmed as to arithmetically determine the concentration of the fuel gas contained in the purge air on the basis of the flow rate or quantity of the purge air fed to the engine 6 and the air-fuel ratio feedback signal indicating the engine operation state.

Additionally, the ECU 20 includes an air port blocking means for controlling the air port control valve 26 to thereby close the atmospheric air port 11, a hermetically closing means for closing both the purge control valve 10 and the atmospheric air port 11 to thereby place the fuel evaporative emission control system as a whole in the hermetically closed state, and an abnormality decision enabling condition detecting means for detecting or determining validity or satisfaction of the conditions for the decision as to occurrence of abnormality in the fuel evaporative emission control system on the basis of the engine operation state in the case where the concentration of the fuel gas is lower than a reference value for comparison (hereinafter also referred to as the comparison reference value). Incidentally, the conditions for the decision as to occurrence of abnormality mentioned just above will also be referred to as the abnormality decision enabling conditions.

Moreover, the ECU 20 includes a purge rate regulating means for regulating or adjusting the purge rate by controlling the opening degree of the purge control valve 10 by taking into account the intake pressure Pb when the abnormality decision enabling conditions are satisfied or validated, and an abnormality detecting means for detecting abnormality of the fuel evaporative emission control system on the basis of the fuel tank pressure Pt which exhibits dependency on the purge rate when the abnormality decision enabling conditions are validated.

The abnormality decision enabling condition detecting means incorporated in the ECU 20 includes a condition validation limiting means for limiting the validation of the abnormality detection enabling conditions. The condition validation limiting means is so designed or programmed as to correct or set variably the comparison reference value mentioned previously in dependence on at least one of the atmospheric pressure PA, the fuel temperature TT, the outside air temperature TG and the intake air temperature TA.

Figure 2:
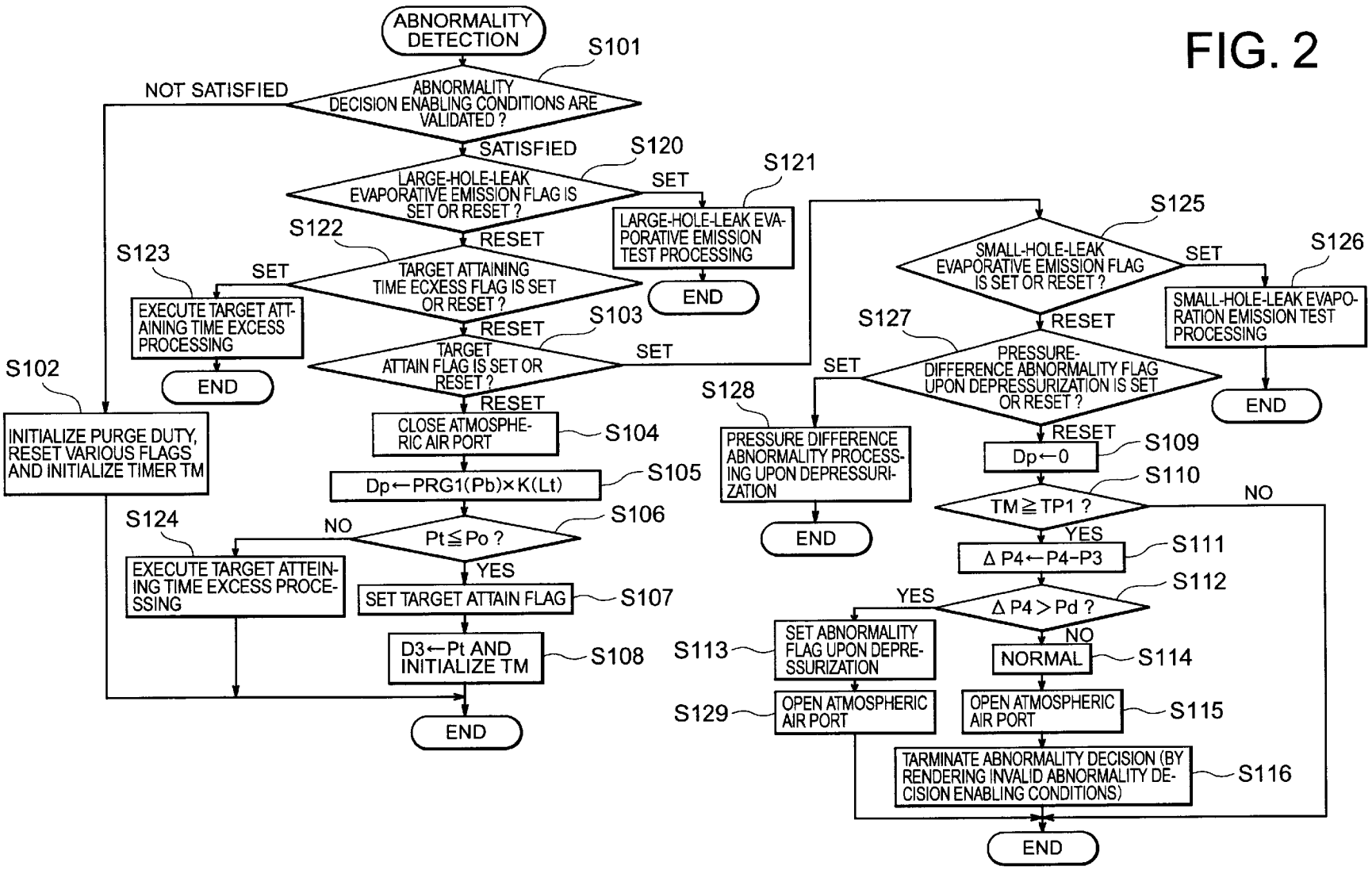
FIG. 2 is a flow chart for illustrating processing routine executed by the apparatus according to the first embodiment of the invention.

Now, referring to a flow chart shown in FIG. 2, description will generally be directed to the abnormality detecting operation performed by the abnormality detecting apparatus according to the first embodiment of the invention shown in FIG. 1.

FIG. 2 shows a processing routine as a whole which is executed by the ECU 20. This processing routine is called periodically at a predetermined time interval for execution.

Referring to FIG. 2, decision is first made as to whether or not the current operation state of the internal combustion engine satisfies abnormality decision enabling conditions (step S101). When the operation state does not satisfy the abnormality decision enabling conditions (i.e., unless the abnormality decision enabling conditions are validated), various parameters are initialized with various flags being reset (step S102), whereon the processing routine shown in FIG. 2 is terminated (END).

In the initialization step S102, the ECU 20 sets the purge duty Dp for the purge control valve 10 to a map value determined in dependence on the engine rotation number Ne and the charging efficiency Ec which in turn is arithmetically determined from the engine rotation number Ne and the intake air flow.

Further, a timer TM is initialized (TM=0) in the step S102. This timer MT is designed for measuring a time lapse in the course of purging operation with the atmospheric air port 11 being closed (i.e., in the course of lowering of the fuel tank pressure Pt to the negative pressure level or depressurization), a hermetical closure time period after the fuel tank pressure Pt has attained a target pressure level Po (i.e., the time period after the fuel tank pressure Pt has attained the target pressure level Po on the negative side) and a hermetical closure time period from a time point at which the fuel tank pressure is close to the atmospheric pressure.

Furthermore, in the step S102, the air port control valve 26 is driven for opening the atmospheric air port 11 of the canister 9. Additionally, a target attain flag and a target attaining time excess flag for the fuel tank pressure Pt, a large-hole-leak evaporative emission test flag and a small-hole-leak evaporative emission test flag, and a pressure difference abnormality flag for depressurization are all reset. After execution of the step S102, the processing routine shown in FIG. 2 is terminated (END).

On the other hand, when decision is made in the step S101 that the engine operation state satisfies the abnormality decision enabling conditions (i.e., when the abnormality decision enabling conditions are validated), the state of the large-hole-leak evaporative emission test flag is checked in a step S120. When it is decided in the step S120 that the large-hole-leak evaporative emission test flag is set, a large-hole-leak evaporative emission test processing is carried out in a step S121, whereon the processing routine shown in FIG. 2 is terminated (END).

By contrast, when it is decided in the step S120 that the large-hole-leak evaporative emission test flag is reset, decision is then made in a step S122 as to whether or not the target attaining time excess flag for the fuel tank pressure Pt is set. When the decision in the step S122 results in that the target attaining time excess flag is set, then the processing to be executed when the time taken for the fuel tank pressure to reach the target level becomes excessive (i.e., target attaining time excess processing) is executed in a step S123, whereon the processing routine shown in FIG. 2 is terminated (END).

On the other hand, when it is decided in the step S122 that the target attaining time excess flag is reset (i.e., when it is decided that the time taken for attaining the target fuel tank pressure level is not exceeded), decision is then made as to the state of the target attain flag in a step S103.

More specifically, in the step S103, decision is made as to whether or not the fuel tank pressure Pt detected by the fuel tank pressure sensor 19 has ever reached or attained the desired or target pressure level Po.

When the decision in the step S103 results in that the target attain flag is reset (indicating that the fuel tank pressure Pt has not yet reached the target pressure level Po), the air port control valve 26 is closed to thereby block the atmospheric air port 11 of the canister 9 (step S104).

Additionally, the purge duty Dp is set to a value TPRG1 (Pb) mapped on the basis of the intake pressure Pb (step S105).

In that case, the purge duty Dp is corrected by a correcting coefficient K(Lt) which bears dependency on the fuel level Lt in accordance with the following expression:

$$Dp = \mathrm{TPRG1} \times K(Lt)$$

In succession, decision is made in a step S106 as to whether or not the fuel tank pressure Pt has attained the desired or target pressure level Po. When it is decided in the step S106 that the fuel tank pressure Pt is higher than the target pressure level Po (i.e., when the decision step S106 results in negation "NO"), the target attaining time excess processing is carried out in a step S124, whereon the processing routine shown in FIG. 2 is terminated (END).

By contrast, when it is decided in the step S106 that the fuel tank pressure Pt is equal to or lower than the target pressure level Po (i.e., when Pt≦Po with the decision step S106 resulting in affirmation "YES"), the target attain flag is set (step S107).

In succession, the fuel tank pressure Pt at this time point is stored as a value "P3" and the timer TM is initialized (TM=0) in a step S108, whereon the processing routine shown in FIG. 2 comes to an end (END).

At this juncture, it is presumed that the timer TM is constantly incremented after the fuel tank pressure Pt has attained the target pressure level Po although illustration is omitted.

On the other hand, when it is decided in the step S103 that the target attain flag is set (indicating that the fuel tank pressure Pt has already attained the target pressure level Po), then decision is made in a step S125 as to the state of the small-hole-leak evaporative emission test flag. When it is decided in the step S125 that this flag is set, a small-hole-leak evaporative emission test processing is carried out in a step S126, whereon the processing routine shown in FIG. 2 is terminated (END).

By contrast, when it is decided in the step S125 that the small-hole-leak evaporative emission test flag is reset, then decision is made in a step S127 as to the state of the pressure difference abnormality flag which is associated with the depressurization. When it is decided in the step S127 that the pressure difference abnormality flag is set, the pressure difference abnormality processing upon depressurization is executed (step S128), whereon the processing routine shown in FIG. 2 is terminated (END).

Furthermore, when decision made in the step S127 results in that the pressure difference abnormality flag associated with depressurization is reset, the purge duty Dp is set to zero (DP=0) in a step S109 with the fuel gas being prevented from flowing into the surge tank 4. Thus, the fuel evaporative emission control system is placed in the hermetically closed state.

Succeedingly, decision is made in a step S110 as to whether or not the timer value TM has reached a predetermined time TP1. When it is decided that TM<TP1 (i.e., when the decision step S110 results in "NO"), this means that the predetermined time TP1 has not lapsed yet from the time point at which the fuel tank pressure Pt attained the target pressure level Po with the fuel evaporative emission control system being hermetically closed. Accordingly, the processing routine shown in FIG. 2 is immediately terminated (END).

On the other hand, when it is decided in the step S110 that TM>TP1 (i.e., when the decision step S110 results in "YES"), this means that a time equal to or longer than the predetermined time TP1 has lapsed from the time point at which the fuel evaporative emission control system was hermetically closed after the fuel tank pressure Pt attained the target pressure level Po. Thus, a tank pressure difference ΔP4 between the current fuel tank pressure Pt (=P4) (i.e., the fuel tank pressure after the lapse of the predetermined time TP1) and the preceding fuel tank pressure P3 (i.e., the fuel tank pressure at the time point when the time measurement was started) is arithmetically determined (step S111).

Subsequently, decision is made in a step S112 as to whether or not the tank pressure difference ΔP4 is greater than an abnormal pressure difference Pd. When it is decided in the step S112 that ΔP4>Pd (i.e., when the decision step S112 results in "YES"), an abnormality flag associated with the depressurization is set (step S113) and then the atmospheric air port 11 of the canister 9 is opened (step S129), whereon the processing routine shown in FIG. 2 is immediately terminated (END).

By contrast, when it is decided in the step S112 that ΔP4≦Pd (i.e., when the decision step S112 results in "NO"), it is then determined that the normal state prevails (step S114), whereon the atmospheric air port 11 of the canister 9 is opened (step S115) with the abnormality decision being disabled (i.e., abnormality decision enabling conditions being rendered constantly invalid) in a step S116. Then, the processing routine shown in FIG. 2 is terminated (END).

Next, referring to FIGS. 3 to 9, description will be made in more concrete concerning the processing steps S101, S121, S123, S124, S126 and S128 shown in FIG. 2.

In the first place, referring to FIGS. 3 and 4, description will be made of the processing for deciding the validity of the abnormality decision enabling conditions (step S101 in FIG. 2).

Figures 3, 4:
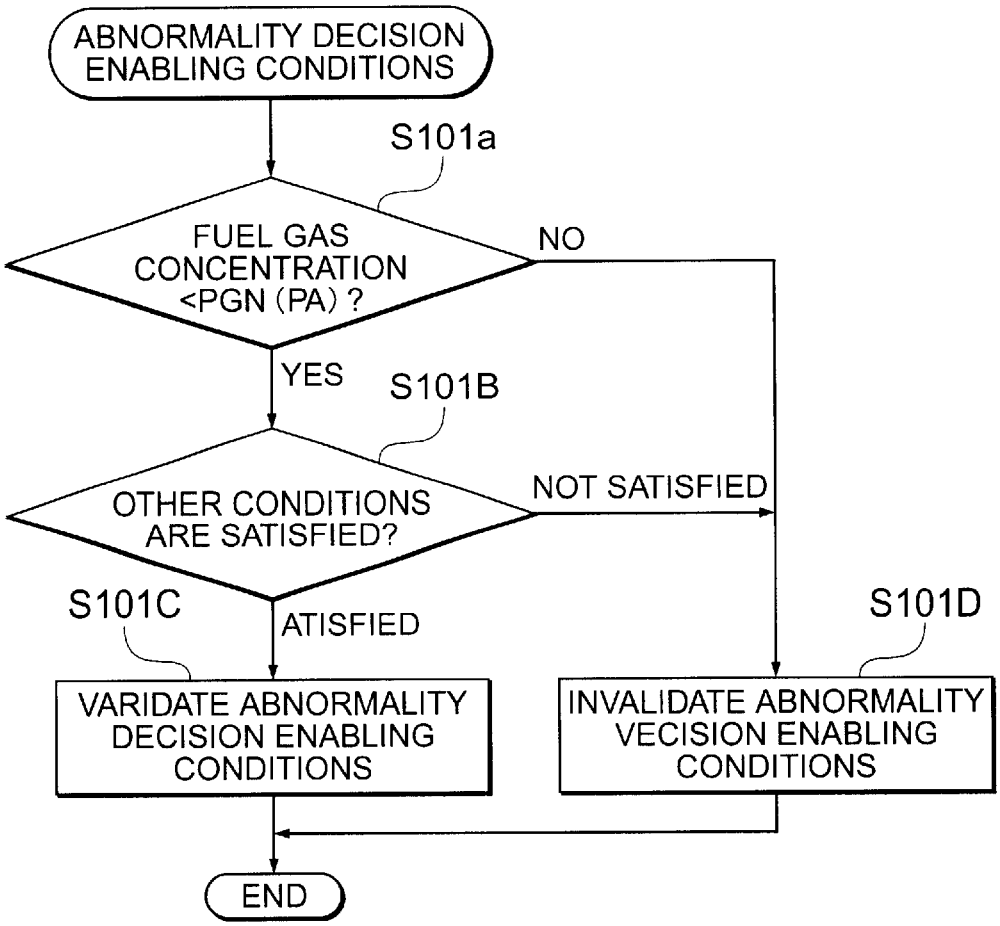
FIG. 3 is a flow chart for illustrating in concrete an abnormality decision enabling condition processing (step S101 in FIG. 2)
FIG. 4 is a view showing a comparison reference value which is set changeably in dependence on the atmospheric pressure according to the first embodiment of the invention.

FIG. 3 is a flow chart for illustrating in concrete the abnormality condition validity decision step S101 mentioned previously by reference to FIG. 2.

Figure 22:
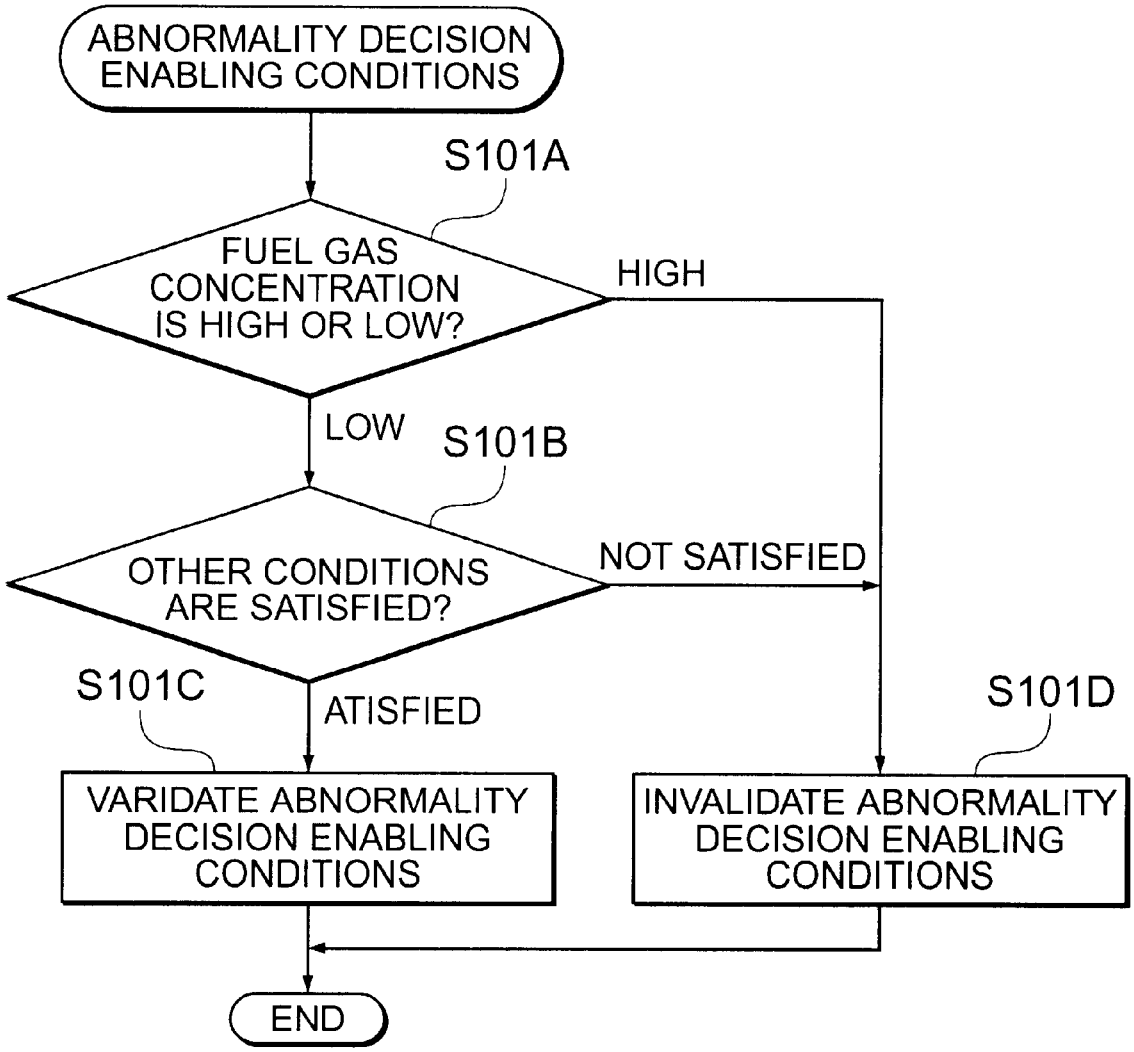
FIG. 22 is a flow chart for illustrating operation of an abnormality decision enabling condition processing routine executed by a conventional abnormality detecting apparatus for a fuel evaporative emission control system.

Referring to FIG. 3, a step S101*a* corresponds to the step S101A described hereinbefore by reference to FIG. 22. Further, steps S101B, S101C and S101D shown in FIG. 3 are similar to those described hereinbefore.

FIG. 4 is a view showing the comparison reference value PGN(PA) employed in the step S101*a* shown in FIG. 3. As can be seen in FIG. 4, the comparison reference value PGN(PA) for the fuel gas concentration is variably set in dependence on the atmospheric pressure PA detected by the atmospheric pressure sensor 30 (see FIG. 1).

Turning back to FIG. 3, the fuel gas concentration of the purge air (i.e., concentration of fuel gas carried by the purge air) which is arithmetically determined on the basis of the engine operation state is firstly compared with the comparison reference value PGN(PA) to thereby decide whether or not the fuel gas concentration value is smaller than the comparison reference value PGN(PA) (step S101*a*).

When it is decided in the step S101*a* that the fuel gas concentration value is equal to or greater than the comparison reference value PGN(PA) (i.e., when the decision step S101*a* results in negation "NO"), the processing proceeds to the step S101D of establishing the unsatisfactoriness or invalidity of the abnormality decision enabling conditions, whereon the processing routine shown in FIG. 3 comes to an end (END).

By contrast, when it is decided in the step S101*a* that the fuel gas concentration value is smaller than the comparison reference value PGN(PA) (i.e., when the decision step S101*a* results in affirmation "YES"), the processing proceeds to a step S101B of checking validity of the other abnormality decision enabling conditions.

At this juncture, it should be noted that the comparison reference value PGN(PA) increases as the atmospheric pressure PA increases (which means that evaporative emission of the fuel becomes more difficult to occur), as can be seen from FIG. 4. Accordingly, the possibility or probability of the abnormality decision enabling conditions being erroneously determined to be invalid in the step S101*a* is reduced.

For taking into account the fact mentioned above, the atmospheric pressure sensor 30 is provided for detecting the atmospheric pressure PA so that the comparison reference value PGN(PA) for the fuel gas concentration in checking validity of the abnormality decision enabling conditions can variably be set in dependence on the atmospheric pressure PA. By virtue of this arrangement, the validity of the abnormality decision enabling conditions can be determined with high accuracy and enhanced reliability.

Figure 5:
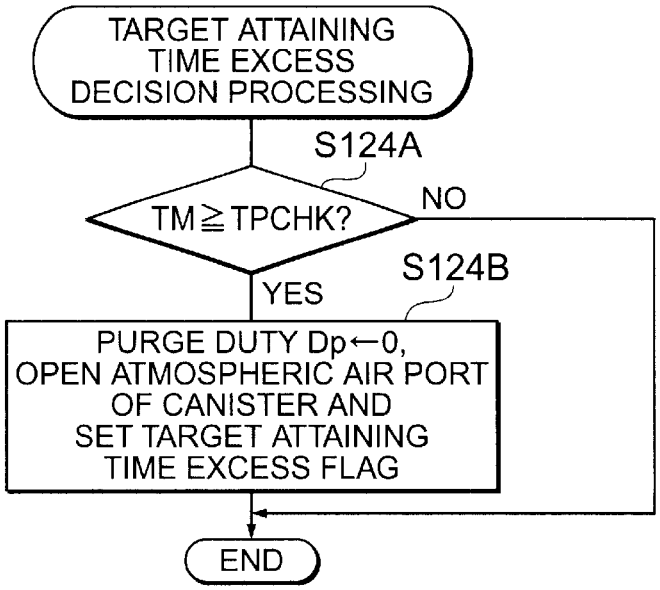
FIG. 5 is a flow chart for illustrating in concrete a target attaining time excess decision processing (step S124 in FIG. 2)

Next, referring to FIG. 5, description will be directed to the target attaining time excess decision processing (step S124 in FIG. 2).

Referring to FIG. 5, the time lapsed from the time point at which the purged fuel was introduced by closing the atmospheric air port 11 in the state where the fuel tank pressure Pt is near to the atmospheric pressure PA is checked by making decision as to whether or not the timer TM indicates that a predetermined check time TPCHK has already passed (i.e., TM≧TPCHK). See step S124A in FIG. 5.

When it is decided in the step S124A that TM<TPCHK (i.e., when the answer of the decision step S124A is "NO"), indicating that the predetermined check time TPCHK has not lapsed yet, the processing routine shown in FIG. 5 is immediately terminated (END).

On the other hand, when the decision step S124A shows that TM≧TPCHK (i.e., when the answer of the decision step S124A is "YES"), this means that the fuel tank pressure Pt has not reached or attained the target pressure level Po on the negative pressure side over an extended time period notwithstanding regardless of the closure of the atmospheric air port 11. In this case, it can be then regarded that the probability of occurrence of the large-hole-leak abnormality is high. Accordingly, preparation is made for the large-hole-leak evaporative emission test.

More specifically, in the step S124A, the purge duty Dp is set to "0" (zero) with the purge control valve 10 being closed. At the same time, the atmospheric air port 11 of the canister 9 is opened to thereby allow the fuel tank pressure Pt to be increased or restored to the atmospheric pressure PA. Additionally, the target attaining time excess flag is set (step S124B) for indicating that the pressure Pt within the fuel tank 8 does not reach the target pressure Po notwithstanding that the time exceeding the timer value has elapsed, whereon the processing routine shown in FIG. 5 comes to an end (END).

Figure 6:
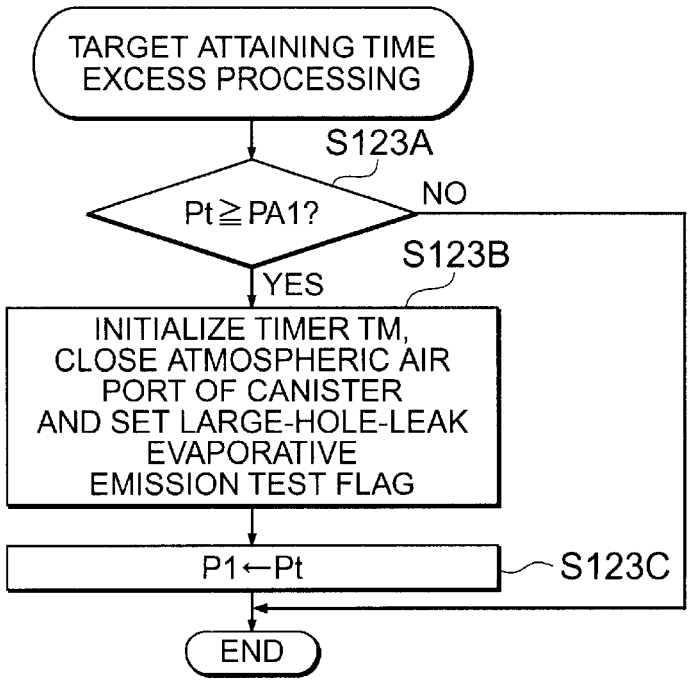
FIG. 6 is a flow chart for illustrating in concrete a time excess processing (step S123 in FIG. 2)

Next, referring to a flow chart shown in FIG. 6, description will be directed to the time excess processing (step S123 in FIG. 2).

Referring to FIG. 6, in a step S123A, decision is first made as to whether or not the fuel tank pressure Pt has attained the restored pressure level (pressure level to be restored) PA1 which is preset near to the atmospheric pressure PA.

When it is decided in the step S123A that the fuel tank pressure Pt is lower than the restored pressure level PA1 (i.e., when the decision step S123A results in "NO"), indicating that the fuel tank pressure Pt close to the atmospheric pressure PA has not been restored yet, then the processing routine shown in FIG. 6 immediately comes to an end (END).

By contrast, when it is decided in the step S123A that the fuel tank pressure Pt is equal to or higher than the restored pressure level PA1 (i.e., when the decision step S123A results in "YES"), indicating that the fuel tank pressure Pt has been already restored to the preset level close to the atmospheric pressure level PA, then initialization processing for starting the large-hole-leak evaporative emission test is executed (step S123B).

More specifically, in the step S123B, the timer TM is initialized for measuring the time lapse from the time point when the fuel tank has been hermetically closed approximately at the atmospheric pressure PA while the fuel evaporative emission control system is placed in the hermetically closed state by closing the atmospheric air port 11, whereon the large-hole-leak evaporative emission test flag is set.

In succession, the fuel tank pressure Pt at the time point where the fuel evaporative emission control system is hermetically closed is stored as a value "P1" (step S123C), whereon the processing routine shown in FIG. 6 comes to an end (END).

Figure 7:
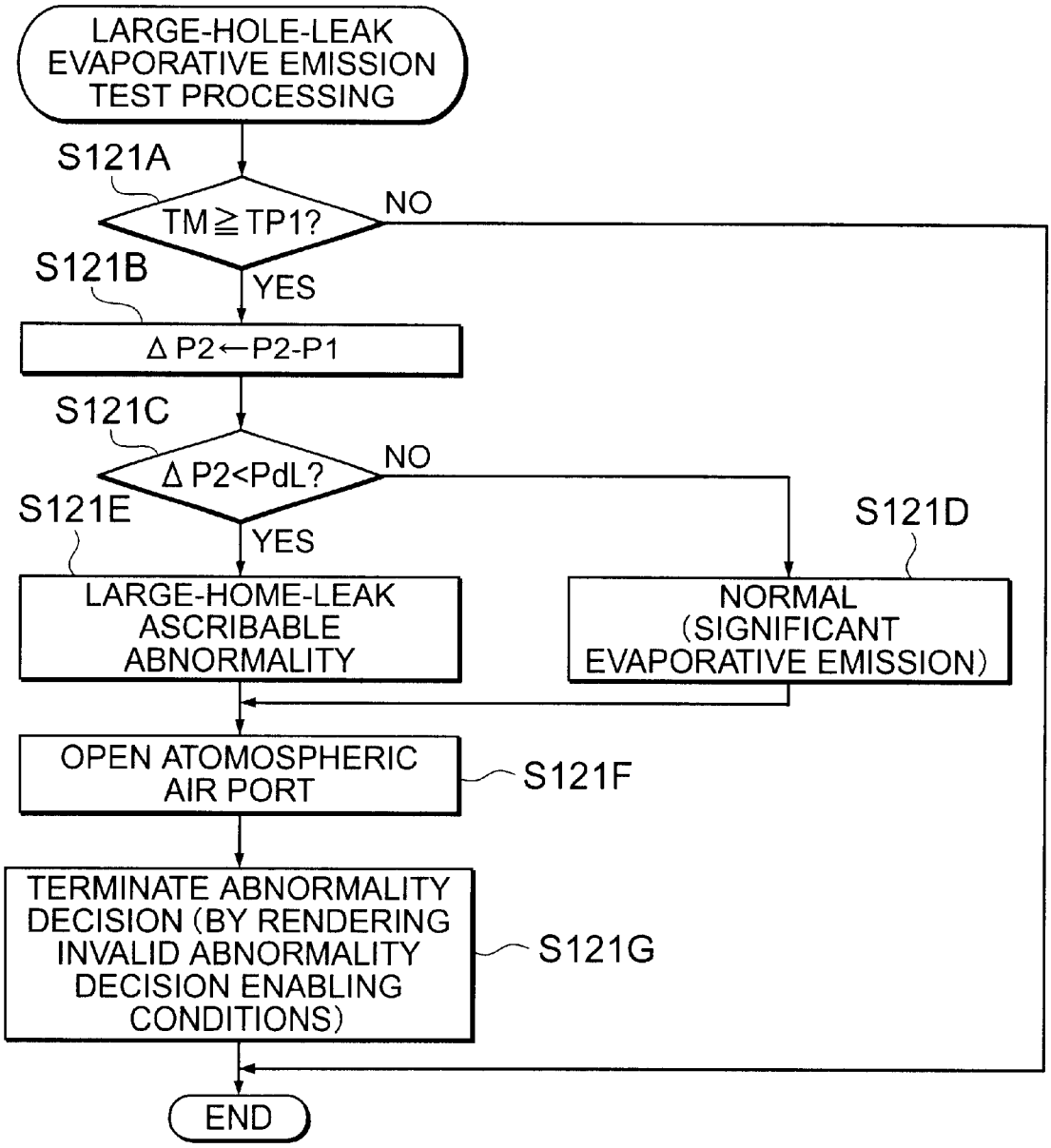
FIG. 7 is a flow chart for illustrating in concrete a large-hole-leak evaporative emission test processing (step S121 in FIG. 2)

Next, referring to FIG. 7, description will be made of the large-hole-leak evaporative emission test processing (FIG. 2, step S121). FIG. 7 is a flow chart for illustrating in concrete the large-hole-leak evaporative emission test processing step S121.

As described previously, the large-hole-leak evaporative emission test processing step S121 is executed in the state where the fuel evaporative emission control system including the canister 9 is hermetically closed and where the fuel tank pressure Pt is close to or approximately equal to the atmospheric pressure PA.

Referring to FIG. 7, decision is first made in a step S121A as to whether or not the timer value TM has reached the predetermined time value TP1. When it is decided that TM<TP1 (i.e., when the decision step S121A results in "NO"), this means that the predetermined time TP1 has not lapsed yet from the time point at which the fuel evaporative emission control system was hermetically closed at the fuel tank pressure level Pt close to the atmospheric pressure PA. In that case, the processing routine shown in FIG. 7 is immediately terminated (END).

On the contrary, when it is decided in the step S121A that TM≧TP1 (i.e., when the decision step S121A results in "YES"), this means that the preset or predetermined time TP1 has lapsed from the time point at which the fuel evaporative emission control system was hermetically closed at the fuel tank pressure level Pt close to the atmospheric pressure PA. In this case, a tank pressure difference ΔP2 between the current fuel tank pressure Pt (=P2), i.e., the fuel tank pressure after the lapse of the predetermined time TP1, and the preceding fuel tank pressure P1 (i.e., the fuel tank pressure at the time point when the timer measurement was started) is arithmetically determined (step S121B).

In succession, in a step S121C, decision is made whether or not the tank pressure difference ΔP2 is smaller than an abnormal large-hole-leak pressure difference PdL (i.e., abnormal pressure difference ascribable to a large-hole leak). When it is decided in the step S121C that the tank pressure difference ΔP2 is equal to or greater than the abnormal large-hole-leak pressure difference PdL (i.e., when the decision step S121C results in "NO"), it can be regarded that increase of the pressure due to the evaporative emission of the fuel is significant. Thus, it is determined that the fuel tank pressure Pt could not attain the target pressure level Po due to the evaporative emission of the fuel and hence the fuel evaporative emission control system is in the normal or healthy state (step S121D). Accordingly, the atmospheric air port 11 of the canister 9 is opened (step S121F).

By contrast, when it is decided in the step S121C that ΔP2 <PdL (i.e., when the decision step S121C results in "YES"), it can then be regarded that the increase of the pressure caused due to the evaporative emission of the fuel is not so significant. Thus, it is determined that the abnormal large-hole leak takes place. In this case, the atmospheric air port 11 of the canister 9 is also opened (step S121F).

Finally, abnormality decision disable processing (i.e., processing for rendering the abnormality decision enabling conditions to be constantly invalid) is performed in a step S121G. Then, the processing routine shown in FIG. 7 comes to an end (END).

Next, referring to a flow chart shown in FIG. 8, description will be made of the pressure difference abnormality processing upon depressurization (pressure lowering) (FIG. 2, step S128).

Figure 8:
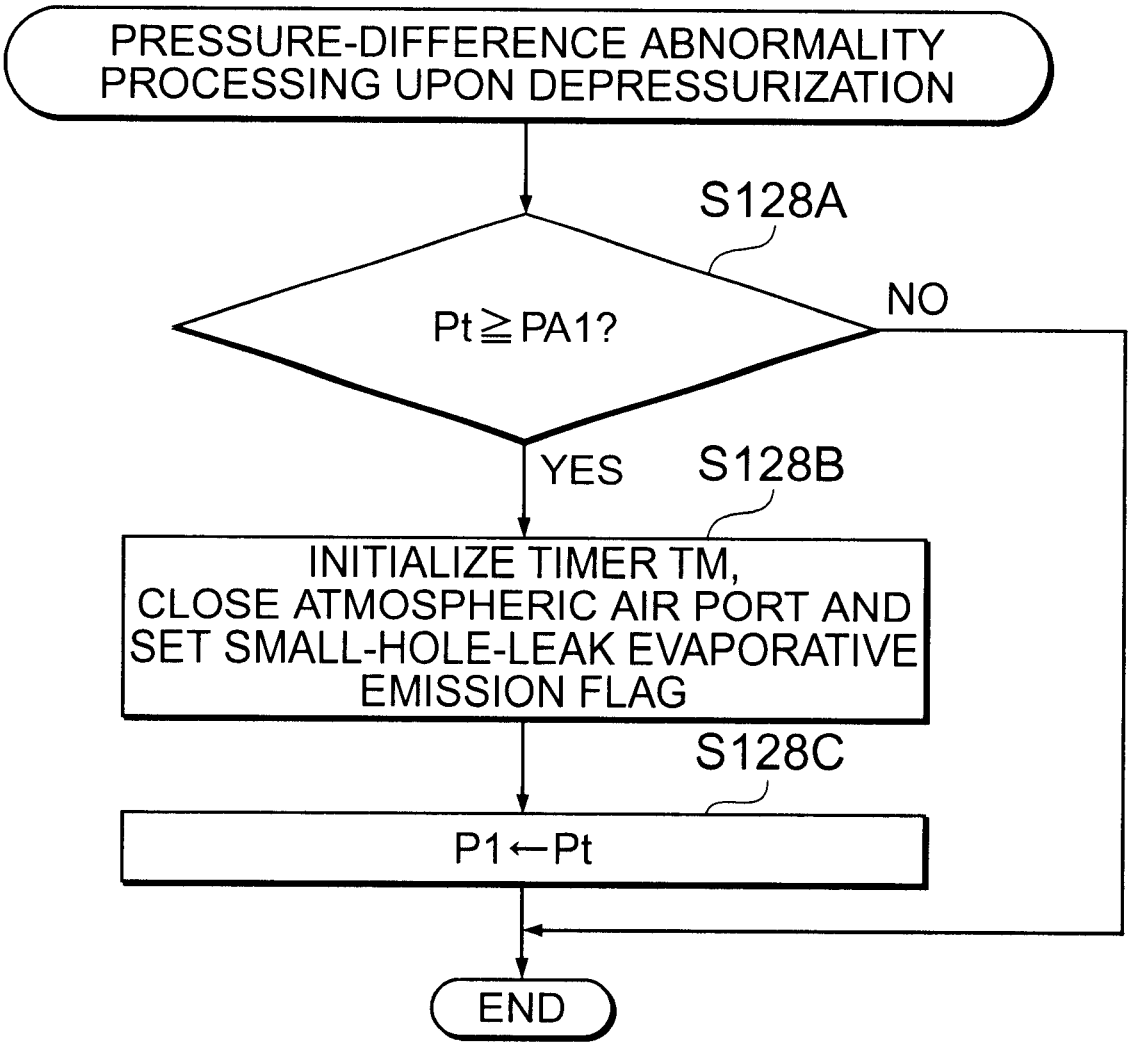
FIG. 8 is a flow chart for illustrating in concrete a pressure difference abnormality processing (step S128 in FIG. 2)

Referring to FIG. 8, steps S128A, S128B and S128C correspond, respectively, to the steps S123A, S123B and S123C described previously (see FIG. 6).

At first, in a step S128A, decision is made as to whether or not the fuel tank pressure Pt has attained a level which is equal to or higher than the restored pressure PA1 in the state where the purge control valve 10 is closed with the atmospheric air port 11 being opened.

When it is decided in the step S128A that Pt<PA1 (i.e., when the decision step S128A results in "NO"), indicating that the fuel tank pressure Pt has not been restored yet to a level close to the atmospheric pressure PA. In that case, the processing routine shown in FIG. 8 is immediately terminated (END).

By contrast, when it is decided in the step S128A that Pt≧PA1 (i.e., when the decision step S128A results in "YES"), indicating that the fuel tank pressure Pt has already been restored close to the atmospheric pressure PA, then initialization processing for starting the small-hole-leak evaporative emission test is performed in a step S128B.

More specifically, in the step S128B, the timer TM is initialized with the aim of measuring the time lapse of the hermetically closed state set approximately at the atmospheric pressure PA while the fuel evaporative emission control system is placed in the hermetically closed state by closing the atmospheric air port 11, and the small-hole-leak evaporative emission test flag is set.

Subsequently, the fuel tank pressure Pt at the time point when the hermetical closure state is set is stored as "P1" (step S128C), whereon the processing routine shown in FIG. 8 comes to an end (END).

Figure 9:
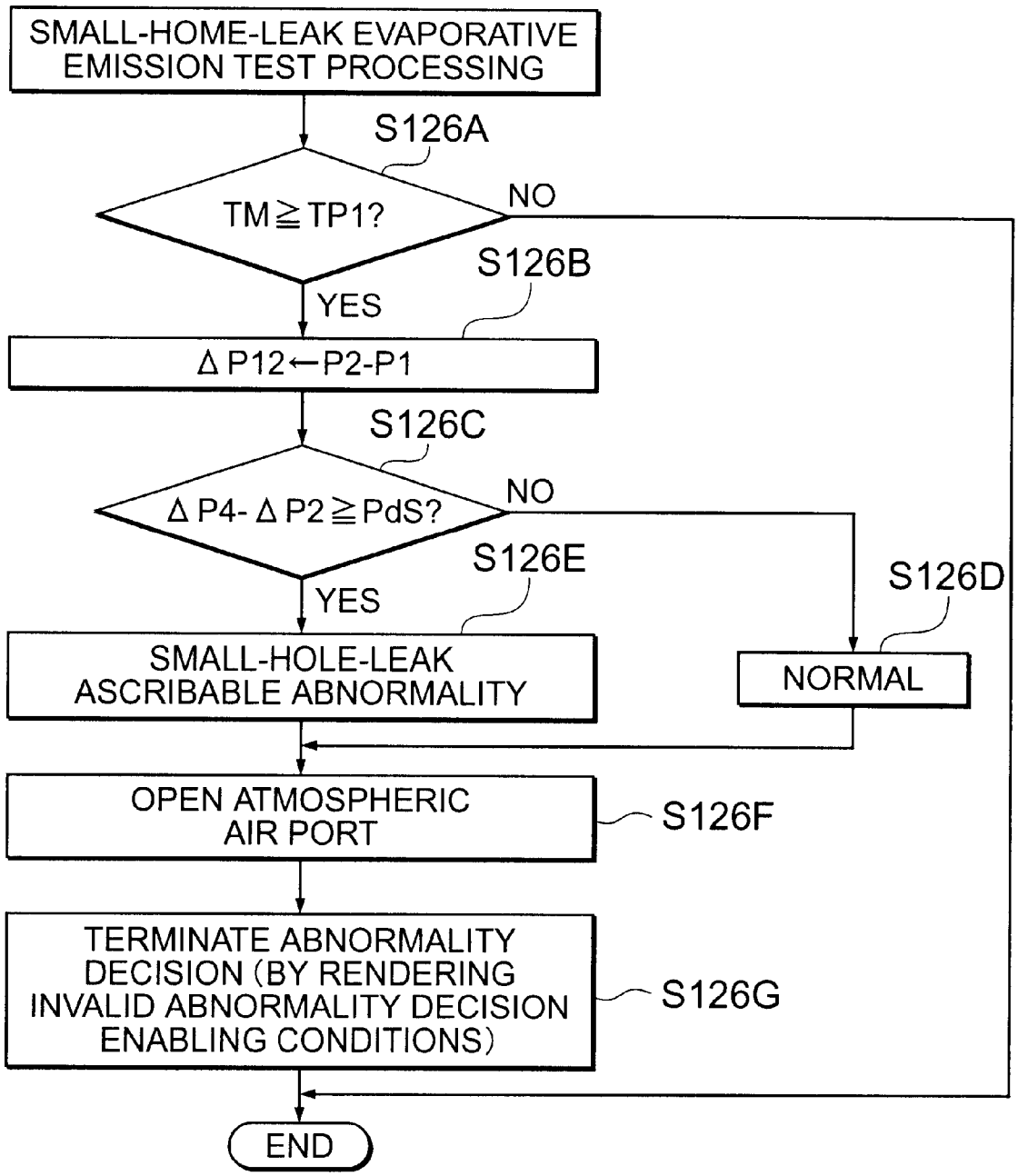
FIG. 9 is a flow chart for illustrating in concrete a small-hole-leak evaporative emission test processing (step S126 in FIG. 2)

Next, referring to FIG. 9, description will be directed to the small-hole-leak evaporative emission test processing (FIG. 2, step S126).

FIG. 9 is a flow chart for illustrating in concrete the small-hole-leak evaporative emission test processing (step S126 in FIG. 2). In the figure, steps S126A, S126B, S126C, S126D, S126E, S126F and S126G correspond, respectively, to the steps S121A, S121B, S121C, S121D, S121E, S121F and S121G described previously by reference to FIG. 7.

Referring to FIG. 9, decision is first made as to whether or not the timer value TM has reached or exceeded a predetermined time value TP1 (step S126A). When it is decided that TM<TP1 (i.e., when the decision step S126A results in "NO"), this means that the predetermined time TP1 has not lapsed yet from the time point at which the fuel evaporative emission control system was hermetically closed in the state where the fuel tank pressure Pt is close to the atmospheric pressure PA. In that case, the processing routine shown in FIG. 9 is immediately terminated (END).

On the other hand, when it is decided in the step S126A that TM≧TP1 (i.e., when the decision step S126A results in "YES"), this means that the predetermined time TP1 has lapsed from the time point at which the fuel evaporative emission control system was hermetically closed in the state where the fuel tank pressure Pt is close to the atmospheric pressure PA. Accordingly, the tank pressure difference ΔP2 between the current fuel tank pressure Pt (=P2) after lapse of the predetermined time TP1 and the preceding fuel tank pressure P1 measured at the time point when the timer operation was started is arithmetically determined (step S126B).

Subsequently, pressure difference ΔP between the tank pressure differences ΔP4 and ΔP2 (=ΔP4−ΔP2) is arithmetically determined. Then, decision is made as to whether or not the pressure difference ΔP is equal to or greater than an abnormal small-hole-leak pressure difference PdS (step S126C). When it is decided in the step S126C that ΔP<PdS (i.e., when the decision step S126C results in "NO"), this means that leak is small, indicating the normal state (step S126D). Accordingly, the atmospheric air port 11 of the canister 9 is opened (step S126F).

On the other hand, when it is decided in the step S126C that ΔP≧PdS (i.e., when the decision step S126C results in "YES"), indicating that the leakage is large, abnormal small-hole leak (i.e., abnormality ascribable to the small-hole leak) is determined. Then, the atmospheric air port 11 of the canister 9 is opened (step S126F).

As is apparent from the above, the small-hole-leak abnormality is decided in the step S126C by reference to the pressure difference ΔP derived by subtracting the tank pressure difference ΔP2 approximately at the atmospheric pressure (immediately after closing of the atmospheric air port) from the tank pressure difference ΔP4 in the negative pressure state (immediately after the interruption of the purge). This is because only the actual leak component has to be checked by eliminating the influence of the evaporative emission of the fuel from the tank pressure difference ΔP4 in the negative pressure state, since the tank pressure difference ΔP2 approximately at the atmospheric pressure corresponds to the increment of pressure due to the evaporative emission of the fuel.

Finally, the abnormality decision processing is disabled (i.e., the abnormality decision enabling conditions are rendered to be constantly invalid) in a step S126G, whereon the processing routine shown in FIG. 9 comes to an end (END).

As is apparent from the foregoing, according to the teachings of the present invention incarnated in the first embodiment thereof, the reference value PGN(PA) for comparison of the fuel gas concentration for detecting the leak abnormality event is variably set in accordance with the atmospheric pressure PA in order to take into account the influence of the atmospheric pressure PA. By virtue of this feature, the abnormality decision enabling conditions can be set in conformance with both the case where the atmospheric pressure PA is low as encountered when the motor vehicle equipped with the system according to the invention is running in a highland region (which means that the evaporative emission of the fuel in the fuel tank 8 is easy to occur) and the case where the atmospheric pressure PA is high as encountered in a lowland region (which means that the fuel evaporative emission is difficult to occur). Thus, favorable abnormality detection performance can be realized without incurring erroneous detection regardless of variation of the atmospheric pressure PA.

Embodiment 2

In the case of the abnormality detecting apparatus for the fuel evaporative emission control system according to the first embodiment of the invention, the comparison reference value for the fuel gas concentration employed in determining the validity of the abnormality decision enabling conditions is changed in dependence on the atmospheric pressure PA. However, such arrangement may equally be adopted that by making use of the temperature TT of the fuel contained in the fuel tank 8 which is detected by the fuel temperature sensor 32 (see FIG. 1), the comparison reference value for the fuel gas concentration may be variably or adjustably set in dependence on the fuel temperature TT. A second embodiment of the present invention is concerned with this arrangement.

In the following, description will be made of the abnormality detecting apparatus according to the second embodiment of the invention in which the comparison reference value is changeably set in dependence on the fuel temperature TT.

FIG. 10 is a view showing the comparison reference value PGN(TT) which is set changeably in dependence on the fuel temperature TT according to the second embodiment of the present invention.

Incidentally, the processing procedure for determining the validity of the abnormality decision enabling conditions according to the instant embodiment of the invention is substantially same as that described previously by reference to FIG. 3 except for the only difference that the comparison reference value PGN(PA) which appears in the step S101*a* shown in FIG. 3 is replaced by the comparison reference value PGN(TT).

In the processing procedure according to the instant embodiment of the invention, the comparison reference value PGN(TT) for the fuel gas concentration is changeably set in dependence on the fuel temperature TT in such a manner as shown in FIG. 10.

More specifically, the comparison reference value PGN (TT) becomes smaller as the fuel temperature TT increases (i.e., as the evaporation of the fuel becomes easier to occur), as can be seen from FIG. 10. Accordingly, the possibility of erroneous determination concerning the invalidity of the abnormality decision enabling conditions can advantageously be reduced.

Embodiment 3

In the case of the abnormality detecting apparatus for the fuel evaporative emission control system according to the second embodiment of the invention, the comparison reference value for the fuel gas concentration is changed in dependence on the fuel temperature TT. However, such arrangement may also be adopted that by making use of the intake air temperature TA (or the outside air temperature TG) which is detected by the intake-air temperature sensor 13 or alternatively the outside air temperature sensor 31 (see FIG. 1), the comparison reference value for the fuel gas concentration may be changeably set in dependence on the intake air temperature TA or alternatively the outside air temperature TG. A third embodiment of the present invention is concerned with this arrangement.

In the following, description will be made of the abnormality detecting apparatus for the fuel evaporative emission control system according to the third embodiment of the invention in which the comparison reference value for the fuel gas concentration is changeably set in dependence on the intake air temperature TA or alternatively the outside air temperature TG.

FIGS. 11 and 12 are views which show the comparison reference values PGN(TA) and PGN(TG), respectively, which are set changeably in dependence on the intake air temperature TA and the outside air temperature TG, respectively, according to the teaching of the invention incarnated in the instant embodiment.

Incidentally, the processing procedure for determining the validity of the abnormality decision enabling conditions according to the instant embodiment of the invention are substantially same as that described hereinbefore by reference to the flow chart shown in FIG. 3 except for the only difference that the comparison reference value PGN(PA) appearing in the step S101*a* shown in FIG. 3 is replaced by PGNL(PA) in a step S101L.

Referring to FIG. 11, the comparison reference value PGN(TA) for the fuel gas concentration is so set as to change in dependence on the intake air temperature TA. More specifically, the comparison reference value PGN(TA) for the fuel gas concentration becomes smaller as the intake air temperature TA increases (i.e., as the evaporative emission of the fuel becomes easier to occur).

Similarly, the comparison reference value PGN(TG) becomes smaller as the outside air temperature TG increases, as can be seen in FIG. 12.

Accordingly, the probability of erroneous decision concerning invalidity of the abnormality decision enabling conditions can be reduced similarly to the embodiments described hereinbefore by adopting either the comparison reference value PGN(TA) or PGN(TG).

Embodiment 4

In the case of the abnormality detecting apparatus for the fuel evaporative emission control system according to the first to third embodiments of the present invention, the comparison reference value for the fuel gas concentration is changed in dependence on only one of the parameters, i.e., the atmospheric pressure PA, the fuel temperature TT and the intake air temperature TA or alternatively the outside air temperature TG. However, such arrangement may equally be adopted that the comparison reference value for the fuel gas concentration may be changeably set in dependence on a plurality of such parameters. A fourth embodiment of the present invention is directed to this arrangement.

In the following, description will be made of the abnormality detecting apparatus according to the fourth embodiment of the invention in which the comparison reference value is changeably set in dependence on a plurality of parameters.

FIGS. 13A and 13B are views for illustrating the comparison reference value PGN which is set changeably in dependence on the plural parameters according to the fourth embodiment of the invention. More specifically, FIG. 13A shows the comparison reference value PGN(PA) which is set changeably in dependence on the atmospheric pressure PA similarly to the case described hereinbefore by reference to FIG. 4 while FIG. 13B shows a correcting coefficient KPGN(TT) which is set changeably in dependence on the fuel temperature TT.

In this conjunction, it is to be noted that the comparison reference value PGN is determined by the product of the comparison reference value PGN(PA) and the correcting coefficient KPGN(TT). Namely, $$PGN=PGN(PA)\times KPGN(TT)$$

By setting the comparison reference value PGN for the fuel gas concentration by taking into consideration a plurality of parameters as described above, determination as to the validity of the abnormality decision enabling conditions can be realized with significantly enhanced accuracy and reliability.

In the instant embodiment of the invention, the comparison reference value PGN is changeably set in dependence on the atmospheric pressure PA and the fuel temperature TT. It should however be added that the comparison reference value PGN may also be changeably set by additionally combining appropriately the outside air temperature TG or the intake air temperature TA. Needless to say, as the number of the parameters employed increases, the reliability of the comparison reference value PGN can correspondingly be enhanced or improved.

In other words, by setting changeably the comparison reference value for the fuel gas concentration for detecting the abnormal leakage by taking into consideration the susceptibility of the fuel to evaporative emission under the influence of various types of parameters such as the fuel temperature TT, the intake air temperature TA, the outside air temperature TG and/or the like, the reliability of the decision enabling conditions can further be enhanced, whereby highly improved abnormality detection performance can be ensured and sustained without incurring any appreciable erroneous detection.

Embodiment 5

In the case of the abnormality detecting apparatus for the fuel evaporative emission control system according to the first embodiment of the invention, no consideration has been paid to the comparison reference values which are relevant to the large-hole-leak abnormality and the small-hole-leak abnormality, respectively, in the determination of the validity of the abnormality decision enabling conditions on the basis of the concentration of the fuel gas. However, such arrangement may be adopted that the comparison reference values are separately or distinctively set for the large-hole-leak abnormality and the small-hole-leak abnormality, respectively. A fifth embodiment of the present invention concerns the arrangement mentioned above.

In the following, description will be made of the abnormality detecting apparatus for the fuel evaporative emission control system according to the fifth embodiment of the invention in which the comparison reference value is distinctively set for each of the large-hole-leak abnormality and the small-hole-leak abnormality, respectively.

FIGS. 14 and 15 are views showing the comparison reference values which are set distinctively for large-hole-leak abnormality and small-hole-leak abnormality, respectively, according to the teaching of the present invention incarnated in the fifth embodiment. More specifically, FIG. 14 shows a comparison reference value PGNL(PA) for determining the large-hole-leak abnormality while FIG. 15 shows a comparison reference value PGNS(PA) for determining the small-hole-leak abnormality, wherein each of the comparison reference values PGNL(PA) and PGNS(PA) is changeably set in dependence on the atmospheric pressure PA.

Incidentally, in the instant embodiment of the invention, it is presumed that the comparison reference value is changeably set in dependence on the atmospheric pressure PA employed as the parameter. However, this is only for the purpose of illustration. It should be appreciated that other appropriate parameters may be employed independently or alternatively in combination, as described previously.

Figure 16:
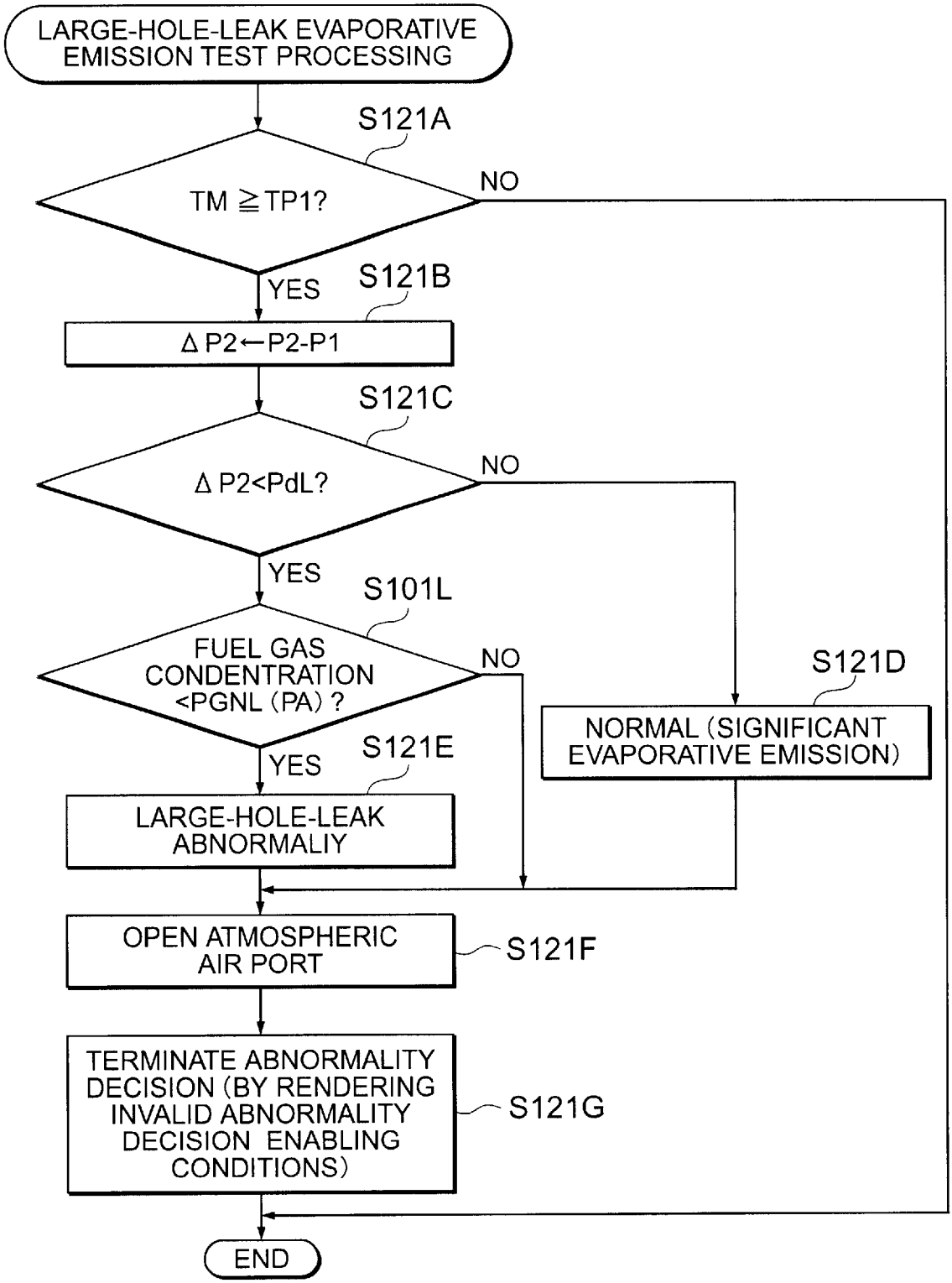
FIG. 16 is a flow chart for illustrating in concrete a large-hole-leak evaporative emission test processing routine according to the fifth embodiment of the invention.
Figure 17:
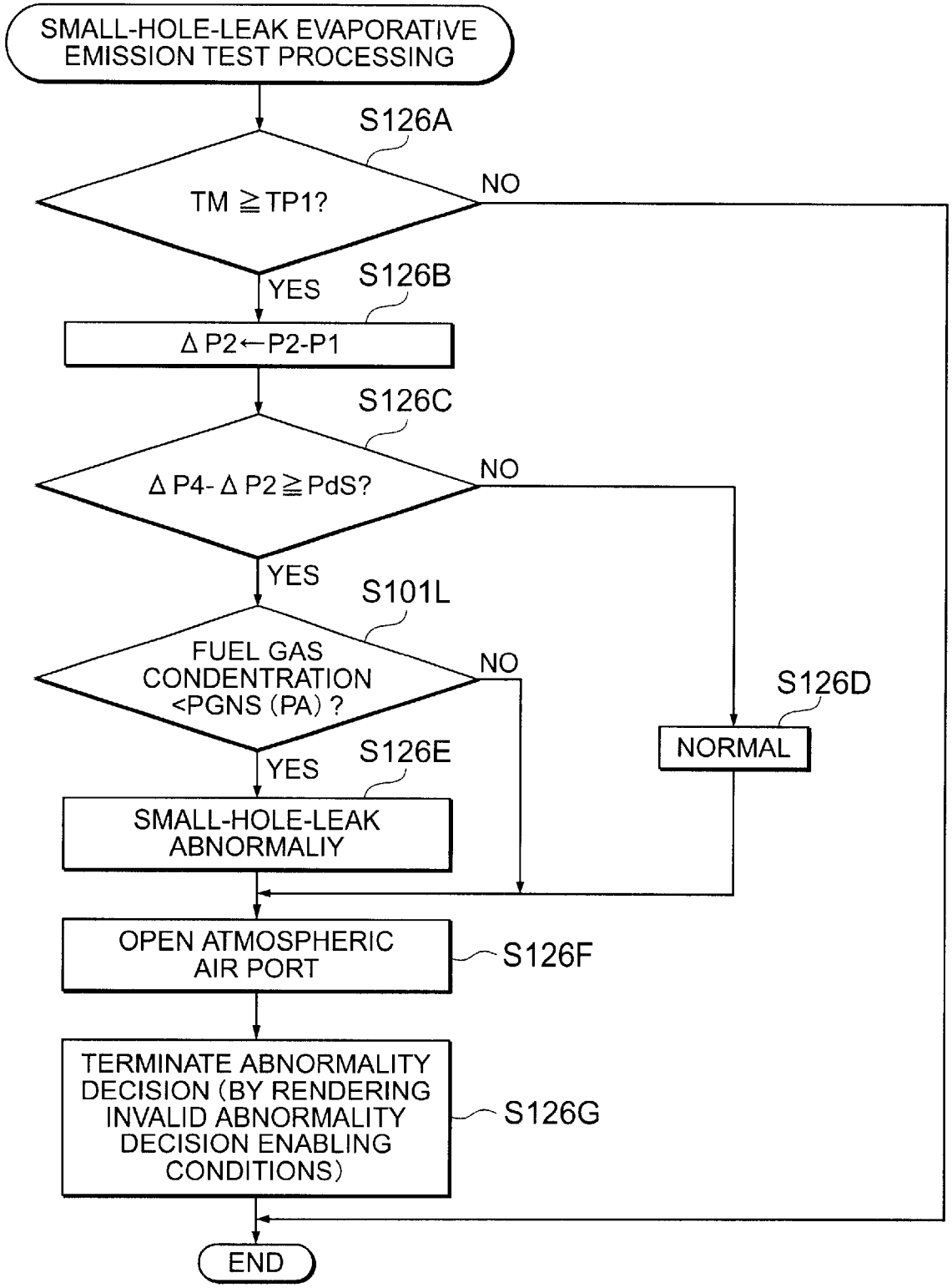
FIG. 17 is a flow chart for illustrating in concrete a small-hole-leak evaporative emission test processing routine according to the fifth embodiment of the invention.

FIGS. 16 and 17 are flow charts for illustrating the large-hole-leak evaporative emission test processing routine and the small-hole-leak evaporative emission test processing routine, respectively, according to the fifth embodiment of the invention.

Parenthetically, in FIGS. 16 and 17, the steps S121A to S121G and steps S126A to S126G are similar to those described hereinbefore by reference to FIGS. 7 and 9, respectively. Accordingly, repeated description in detail of these steps will be omitted.

Further, each of the steps S101L and S101S shown in FIGS. 16 and 17 corresponds to the step S101*a* of the abnormality decision enabling condition processing procedure described heretofore by reference to FIG. 3.

Referring to FIG. 14, the comparison reference value PGNL(PA) for determining or detecting the large-hole-leak abnormality is set to a relatively large value in general with a view to facilitating determination of the large-hole-leak abnormality in the step S121E shown in FIG. 16 because the influence of the evaporative emission of the fuel to the fuel tank pressure Pt is of less significance in the case of the large-hole-leak abnormality.

By contrast, the comparison reference value PGNS(PA) for determining or detecting the small-hole-leak abnormality (see FIG. 15) is set to a relatively smaller value as a whole when compared with the comparison reference value PGNL (PA) for the large-hole-leak abnormality in consideration of the fact that the influence of the evaporative emission of the fuel to the fuel tank pressure Pt is more significant in the case of the small-hole-leak abnormality and hence it is desirable to make determination of the small-hole-leak abnormality more strict in the step S126E shown in FIG. 17 in order to evade the erroneous determination of the small-hole-leak abnormality.

Now referring to the flow chart of the large-hole-leak evaporative emission test processing routine shown in FIG. 16, it is first decided in a step S101L whether or not the concentration value of the fuel gas is sufficiently low through comparison with the relatively large comparison reference value PGNL(PA) set for the large-hole-leak abnormality (see FIG. 14).

When it is decided in the step S101L that the concentration value of the fuel gas is smaller than the comparison reference value PGNL(PA) (i.e., when the decision step S101L results in "YES"), then the large-hole-leak abnormality is determined in a step S121E.

In this conjunction, it is to be noted that because the comparison reference value PGNL(PA) is large, the abnormality can be determined on the relatively generous or lenient condition concerning the fuel gas concentration.

On the other hand, when it is decided in the step S101L that the fuel gas concentration value is equal to or greater than the comparison reference value PGNL(PA) (i.e., when the decision step S101L results in "NO"), the processing skips the step S121E to proceed to a step S121F where the atmospheric air port 11 of the canister 9 is opened.

Additionally, when the decision step S101L results in "NO", the processing does not proceed to the step S121D of determining the normal state. In other words, neither the normal state nor the abnormal state is determined. The final determination as to the normal or abnormal state is left to the succeeding abnormality decision procedure.

Now, turning to FIG. 17 showing the small-hole-leak evaporative emission test processing, it is decided in a step S101S whether or not the fuel gas concentration value is sufficiently small on the basis of the comparison reference value PGNS(PA) which is selected to be relatively severe or in a narrow range for the small-hole leak evaporative emission test (see FIG. 15).

When it is decided in the step S101S that the fuel gas concentration value is smaller than the comparison reference value PGNS(PA) (i.e., when the decision step S101S results in "YES"), the processing proceeds to a step S126E of determining the small-hole-leak abnormality.

In this case, because the comparison reference value PGNS(PA) is set relatively strict, abnormality concerning the fuel gas concentrations is determined on the restricted or strict conditions in order to exclude the possibility of erroneous determination of the small-hole-leak abnormality.

On the other hand, when it is decided in the step S101S that the fuel gas concentration value is equal to or greater than the comparison reference value PGNS(PA) (i.e., when the decision step S101S results in "NO"), the processing skips the step S126E to proceed to a step S126F where the atmospheric air port 11 is opened.

In this conjunction, it is also to be noted that even in the case where the decision step S101S results in "NO", the processing does not proceed to the step S126D for determining the normal state, but the final determination of the normal or abnormal state is left to the result of the succeeding abnormality decision procedure.

In this manner, the large-hole-leak abnormality can positively be determined substantially without fail by setting distinctively the comparison reference values, respectively, in conformance with the abnormal states (i.e., the large-hole-leak abnormality and the small-hole-leak abnormality) of the fuel evaporative emission control system which can be estimated on the basis of the fuel tank pressure Pt. Moreover, erroneous determination can be avoided by conducting strictly the determination of the small-hole-leak abnormality.

In other words, the favorable abnormality detection performance can be ensured and sustained by adopting the appropriate or proper comparison reference value which is determined by taking into account the susceptibility of the fuel to the evaporative emission within the fuel tank in dependence on the degrees of leaks (e.g. leaks brought about by various causes such as removal of the cap from the fuel tank 8, bending, collapsing or dropout of the purge passage pipe and the like) in the fuel evaporative emission control system.

Embodiment 6

In the case of the abnormality detecting apparatus for the fuel evaporative emission control system according to the first embodiment of the invention, the hermetical closure time period (i.e., predetermined time period during which the fuel evaporative emission control system is placed in the hermetically closed state) TP1 is set to be constant when the tank pressure difference $\Delta P2$ is determined. However, the hermetical closure time period may be set distinctively or separately for the large-hole-leak abnormality and the small-hole-leak abnormality, respectively. A sixth embodiment of the present invention concerns the arrangement mentioned above.

In the following, description will be made of the abnormality detecting apparatus for the fuel evaporative emission control system according to the sixth embodiment of the invention in which the hermetical closure time period is distinctively or separately set for determination of the large-hole-leak abnormality and the small-hole-leak abnormality, respectively.

FIGS. 18 and 19 are views showing the hermetical closure time periods which are set distinctively from each other according to the sixth embodiment of the present invention. More specifically, FIG. 18 shows a hermetical closure time period TPL(TA) set for determination of the large-hole-leak abnormality while FIG. 19 shows a hermetical closure time TPS(TA) set for determination of the small-hole-leak abnormality, wherein each of the hermetical closure time periods TPL(TA) and TPS(TA) is set as a function of the intake air temperature TA.

Incidentally, in the case of the instant embodiment of the invention, it is presumed that the hermetical closure time period is changeably set as a function of the intake air temperature TA serving as a parameter. However, this is only for the purpose of illustration. It should be appreciated that other appropriate parameters may be used independently or alternatively in combination, as described hereinbefore.

Figure 20:
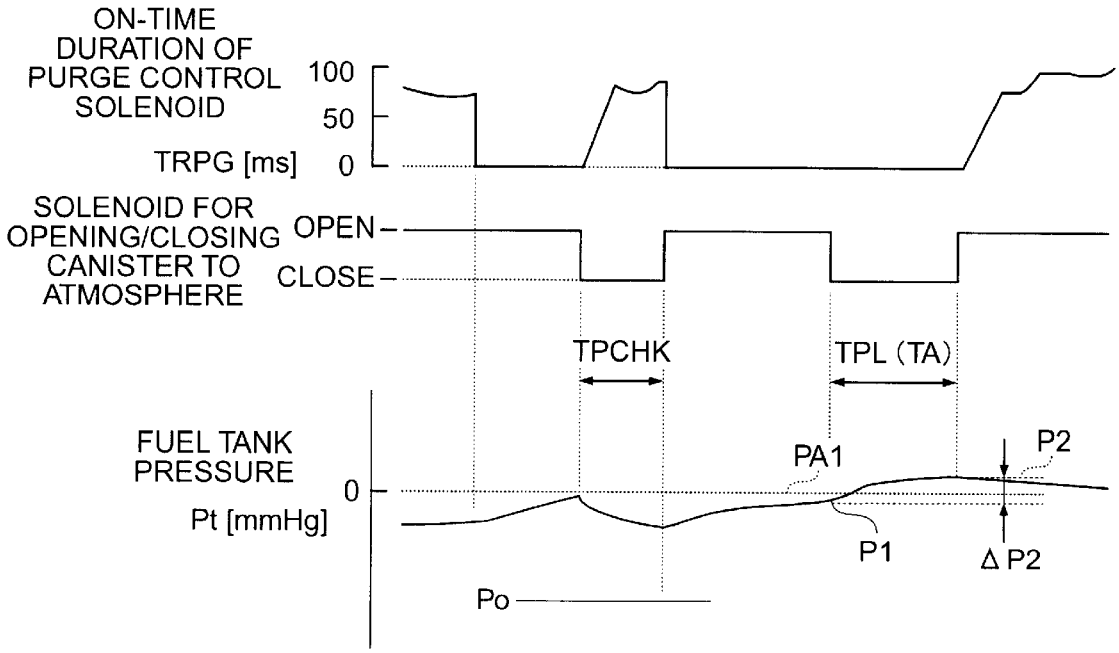
FIG. 20 is a timing chart showing processing operation of the large-hole-leak evaporative emission test according to the sixth embodiment of the invention.
Figure 21:
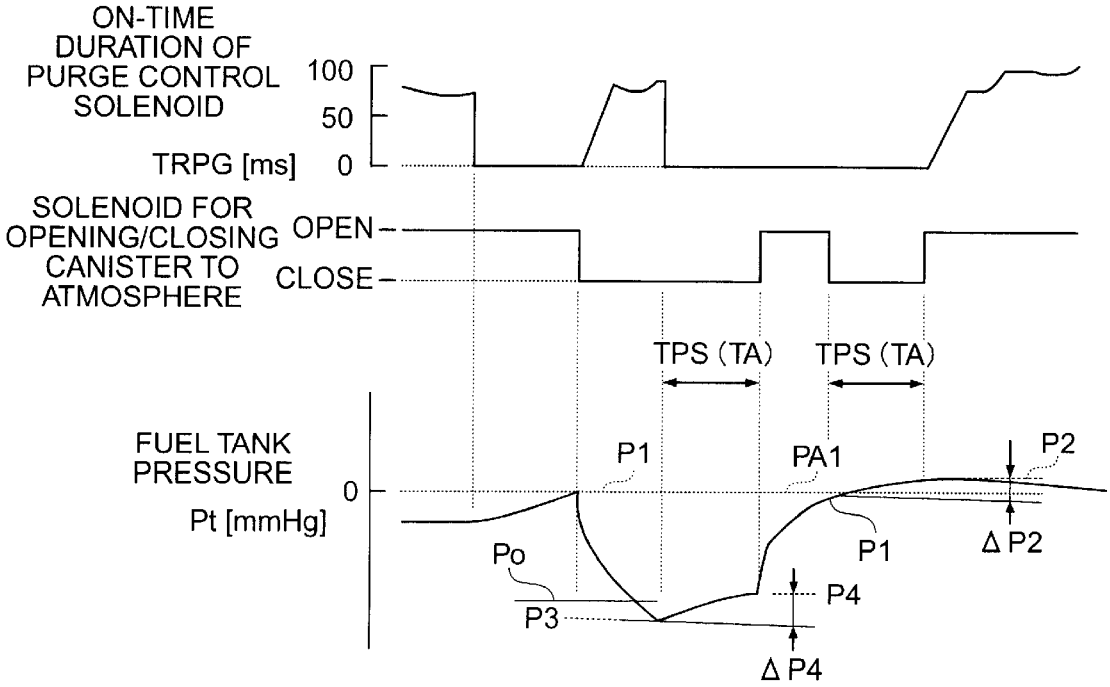
FIG. 21 is a timing chart showing processing operation of the small-hole-leak evaporative emission test according to the sixth embodiment of the invention.

FIGS. 20 and 21 are timing charts showing processing operations involved in the large-hole-leak evaporative emission test processing routine and the small-hole-leak evaporative emission test processing routine, respectively, according to the sixth embodiment of the invention.

Referring to FIGS. 20 and 21, it is to be noted that the time period during which a purge control solenoid is activated (ON) corresponds to the time period for which the purge control valve 10 is opened (i.e., the purge duty Dp).

Further, a solenoid is provided for opening and closing the atmospheric air port 11 of the canister 9. By opening/closing the individual solenoids, the fuel tank pressure Pt can vary, as illustrated in the figures.

The state where both the solenoids are simultaneously closed (i.e., the hermetically closed state) is continuously sustained over a hermetical closure time period TPL(TA) in a large-hole-leak abnormality detection mode (see FIG. 20) while being continuously sustained over a hermetical closure time period TPS(TA) in a small-hole-leak abnormality detection mode (see FIG. 21).

Referring to FIG. 18, the hermetical closure time period TPL(TA) for determining or detecting the large-holeleak abnormality is set to a relatively large value in general with a view to determining the tank pressure difference ΔP2 with ease by setting the hermetical closure time period TPL(TA) long because the influence of the evaporative emission of the fuel to the fuel tank pressure Pt is of less significance in the case of the large-hole-leak abnormality.

By contrast, in the case of FIG. 19, the hermetical closure time period TPS(TA) for determining or detecting the small-hole-leak abnormality is set to a relatively small value when compared with the hermetical closure time period TPL(TA) for determining the large-hole-leak abnormality in consideration of the fact that the influence of the evaporative emission of the fuel to the fuel tank pressure Pt is more significant in the case of the small-hole-leak abnormality and hence the tank pressure difference ΔP1 is determined with ease for a relatively short hermetical closure time period TPS(TA).

In the large-hole-leak abnormality detection mode shown in FIG. 20, the tank pressure difference ΔP2 (=P2−P1) is determined on the basis of the relatively long hermetical closure time period TPL(TA) from the time point at which the fuel tank pressure Pt has converged to or reached the restored pressure level PA1 (≈PA).

In succession, the large-hole-leak abnormality is determined on the basis of the tank pressure difference ΔP2 in the step S121C as described hereinbefore in conjunction with FIG. 7.

By contrast, in the small-hole-leak abnormality detection mode shown in FIG. 21, the tank pressure difference ΔP2 (=P2−P1) is arithmetically determined on the basis of the relatively short hermetical closure time period TPS(TA) from the time point at which the fuel tank pressure Pt has converged to or reached the restored pressure level PA1.

In succession, the small-hole-leak abnormality is determined on the basis of the pressure difference ΔP derived by subtracting the tank pressure difference ΔP2 from the tank pressure difference ΔP4 in the negative pressure state in the step S126C through the similar process described hereinbefore in conjunction with FIG. 9.

In this way, according to the teaching of the present invention incarnated in the sixth embodiment thereof, the hermetical closure time period for which the hermetically closed state (i.e., the state where both the purge control valve 10 and the atmospheric air port 11 are closed) for detecting the leak abnormality is continuously sustained is corrected in dependence on the intake air temperature TA (or alternatively in dependence on the fuel gas concentration, the atmospheric pressure PA, the fuel temperature TT or the outside air temperature TG or combination thereof) while the hermetical closure time period being set changeably and distinctively in dependence on the abnormality detection mode. By virtue of this feature, the reliability of the abnormality decision procedure can further be enhanced.

Besides, in view of the fact that the susceptibility of the fuel to the evaporative emission within the fuel tank 8 varies, for example, in dependence on the atmospheric pressure PA, the outside air temperature TG or the like, the hermetical closure time period is set changeably by taking into consideration the pressure increase during the hermetical closure time period. Owing to this feature, favorable abnormality detection performance can be ensured regardless of change of the atmospheric pressure PA, the outside air temperature TG and the like parameters.

Many modifications and variations of the present invention are possible in the light of the above techniques. It is therefore to be understood that within the scope of the appended claims, the invention may be practiced otherwise than as specifically described.

What is claimed is:

1. An abnormality detecting apparatus for detecting occurrence of abnormality in a fuel evaporative emission control system for an internal combustion engine, comprising:

sensor means for detecting engine operation states including rotation speed and load state of said internal combustion engine;

a purge passage for communicating a fuel tank supplying a fuel to said internal combustion engine and an intake pipe thereof with each other;

a canister disposed at an intermediate location of said purge passage for adsorbing a fuel gas generated within said fuel tank;

an atmospheric air port provided for said canister and opened to the atmosphere;

a purge control valve disposed intermediately between said canister and said intake pipe; and fuel evaporative emission control means for suppressing evaporative emission of the fuel by controlling opening/closing of said purge control valve in dependence on operation states of said internal combustion engine and introducing the fuel gas adsorbed by said canister into said intake pipe as occasion requires, wherein said sensor means includes:

intake pressure detecting means for detecting an intake pressure information representing a load state of said internal combustion engine;

at least one of atmospheric pressure detecting means for detecting an atmospheric pressure, outside air temperature detecting means for detecting an outside air temperature, intake-air temperature detecting means for detecting an intake air temperature of said internal combustion engine, and fuel temperature detecting means for detecting a fuel temperature within said fuel tank;

fuel tank pressure detecting means for detecting a pressure within said fuel tank as a fuel tank pressure;

fuel-gas concentration detecting means for detecting concentration of the fuel gas introduced into said intake pipe from said canister;

air port blocking means for closing said atmospheric air port;

hermetically closing means for closing both said purge control valve and said atmospheric air port to thereby place said fuel evaporative emission control system as a whole in a hermetically closed state;

abnormality decision enabling condition detecting means for determining validity of abnormality decision enabling conditions for allowing decision to be made as to occurrence of abnormality in said fuel evaporative emission control system on the basis of the operation state of said internal combustion engine in the case where said fuel gas concentration is lower than a reference value for comparison;

purge rate regulating means for regulating a purge rate by controlling an opening degree of said purge control valve in dependence on said intake pressure when said abnormality decision enabling conditions are valid; and abnormality detecting means for detecting abnormality of said fuel evaporative emission control system on the basis of said fuel tank pressure which has dependency on said purge rate when said abnormality decision enabling conditions are valid, wherein said abnormality decision enabling condition detecting means includes:

condition validation limiting means for limiting validation of said abnormality detection enabling conditions by correcting said reference value for comparison in dependence on at least one of said atmospheric pressure, said fuel temperature, said outside air temperature and said intake air temperature.

2. An abnormality detecting apparatus for a fuel evaporative emission control system according to claim 1, wherein said condition validation limiting means is so designed as to correct said comparison reference value such that said comparison reference value is decreased when at least one of said atmospheric pressure, said fuel temperature, said outside air temperature and said intake air temperature changes such that the evaporative emission of the fuel is promoted.

3. An abnormality detecting apparatus for a fuel evaporative emission control system according to claim 1, wherein said abnormality decision enabling condition detecting means is so designed as to set distinctively a first comparison reference value and a second comparison reference value, respectively, for a first abnormal state and a second abnormal state which can be presumed on the basis of said fuel tank pressure and change over said first comparison reference value and said second comparison reference value in dependence on said first abnormal state and said second abnormal state, respectively.

4. An abnormality detecting apparatus for a fuel evaporative emission control system according to claim 3, wherein said first abnormal state corresponds to a large-hole-leak abnormality and said second abnormal state corresponds to a small-hole-leak abnormality, and wherein said abnormality decision enabling condition detecting means is so designed as to set said second comparison reference value employed for detecting said second abnormal state to be smaller than said first comparison reference value employed for detecting said first abnormal state.

5. An abnormality detecting apparatus for a fuel evaporative emission control system according to claim 1, wherein said hermetically closing means is so designed as to set changeably a hermetical closure time period during which said fuel evaporative emission control system as a whole is placed in a hermetically closed state in dependence on at least one of said atmospheric pressure, said fuel temperature, said outside air temperature and said intake air temperature.

6. An abnormality detecting apparatus for a fuel evaporative emission control system according to claim 5, wherein said hermetically closing means is so designed as to set distinctively a first hermetical closure time period and a second hermetical closure time period, respectively, for a first abnormal state and a second abnormal state which can be presumed on the basis of said fuel tank pressure and change over said first hermetical closure time period and said second hermetical closure time period in dependence on said first abnormal state and said second abnormal state, respectively.

7. An abnormality detecting apparatus for a fuel evaporative emission control system according to claim 6, wherein said first abnormal state corresponds to a large-hole-leak abnormality and said second abnormal state corresponds to a small-hole-leak abnormality, and wherein said hermetically closing means is so designed as to set said second hermetical closure time period employed for detecting said second abnormal state to be shorter than said first hermetical closure time period employed for detecting said first abnormal state.

* * * * *